US007150652B1

(12) United States Patent
Jeon

(10) Patent No.: US 7,150,652 B1
(45) Date of Patent: Dec. 19, 2006

(54) CONNECTOR HAVING A PAIR OF PRINTED CIRCUITS AND FACING SETS OF CONTACT BEAMS

(76) Inventor: Myoungsoo Jeon, 39422 Zacate Ave., Fremont, CA (US) 94539

( * ) Notice: Subject to any disclaimer, the term of this patent is extended or adjusted under 35 U.S.C. 154(b) by 0 days.

(21) Appl. No.: 11/359,146

(22) Filed: Feb. 21, 2006

(51) Int. Cl.
*H01R 13/648* (2006.01)

(52) U.S. Cl. ..... 439/608; 439/76.1

(58) Field of Classification Search ..... 439/608, 439/76.1, 108, 892
See application file for complete search history.

(56) References Cited

U.S. PATENT DOCUMENTS

| | | | | |
|---|---|---|---|---|
| 3,997,231 | A * | 12/1976 | Sherwood | 439/264 |
| 4,701,136 | A * | 10/1987 | Madeley | 439/76.1 |
| 5,507,654 | A * | 4/1996 | Daly et al. | 439/76.1 |
| 6,247,970 | B1 * | 6/2001 | Ueno et al. | 439/608 |
| D455,125 | S | 4/2002 | Shimoyama et al. | D13/147 |
| 6,379,165 | B1 * | 4/2002 | Lee | 439/108 |
| 6,439,928 | B1 | 8/2002 | Akama et al. | 439/608 |
| 6,533,614 | B1 | 3/2003 | Akama et al. | 439/608 |
| 6,561,850 | B1 * | 5/2003 | Letourneau et al. | 439/608 |
| 6,729,890 | B1 | 5/2004 | Shin | 439/74 |
| 6,793,506 | B1 | 9/2004 | Hirata et al. | 439/74 |
| 6,805,586 | B1 | 10/2004 | Adama et al. | 439/608 |
| 6,811,411 | B1 | 11/2004 | Hirata et al. | 439/74 |
| 6,923,664 | B1 | 8/2005 | Ito et al. | 439/108 |

OTHER PUBLICATIONS

"Differential Connector—FCN-260(D) Series, microGiGaCN Stacking Connector", by Fujitsu, 16 pages (Jun. 15, 2005).

* cited by examiner

*Primary Examiner*—Michael C. Zarroli
(74) *Attorney, Agent, or Firm*—Imperium Patent Works; Darien K. Wallace; T. Lester Wallace

(57) ABSTRACT

A connector assembly includes a male connector and a female connector. The female connector includes two printed circuit assembly portions (PCAPs). Each PCAP includes a printed circuit having a ground plane and a plurality of conductors. A plurality of contact beams are attached to the conductors so that the PCAP structure resembles a comb. The two PCAPs are disposed in an insulative portion of the female connector such that the two rows of contact beams face one another. The male connector also includes two PCAPs. The PCAPs in the male connector do not have contact beams but rather have exposed conductors. When the male and female connectors are mated, the contact beams on the female connector make contact with the exposed conductors on the PCAPs in the male connector. The structure of the PCAPs in the assembly are microstrip-like and the characteristic impedance through the mated connectors is substantially uniform.

20 Claims, 19 Drawing Sheets

CONNECTOR HAVING A PAIR OF PRINTED CIRCUITS AND FACING SETS OF CONTACT BEAMS

TECHNICAL FIELD

The present invention relates generally to high-speed connectors.

BACKGROUND INFORMATION

FIG. 1 (Prior Art) is a perspective view of stacked connector assembly 1. Stacked connector assembly 1 includes a male surface mount connector 2 and a female surface mount connector 3.

FIG. 2 (Prior Art) is cross-sectional view of male connector 2 and female connector 3 of FIG. 1. The cross-section of the male connector 2 reveals a pair of L-shaped metal pieces 4 and 5, referred to here as pins. These pins are inserted into holes in an insulative portion 6 so that the pins stay in place as illustrated. The upper portion of pin 4 is a solder tail 7. The upper portion of pin 5 is a solder tail 8. The solder tails 7 and 8 are soldered to corresponding conductors of a printed circuit board 9 so that male connector 2 is physically fixed to the first printed circuit board.

The cross-section of the female connector 3 reveals a pair of metal inserts 10 and 11. Metal insert 10 has a solder tail portion 12 and a flexing contact portion 13. Metal insert 11 has a solder tail portion 14 and a flexing contact portion 15. The inserts 10 and 11 are inserted into holes in an insulative portion 16 so that the inserts stay in place as illustrated. The solder tail portions 12 and 14 are for soldering to corresponding conductors on the top of a second printed circuit board 17.

FIG. 3 (Prior Art) is a cross-sectional view of male connector 2 and female connector 3 of FIG. 2 when the two connectors are mated. Contact portion 13 presses inward to the right on pin 4 thereby establishing a first conductive path through the connector assembly between solder tail 7 and solder tail 12. Similarly, contact portion 15 pressed inward on pin 5 to the left thereby establishing a second conductive path through the connector assembly between solder tail 8 and solder tail 14.

FIG. 4 (Prior Art) is a simplified diagram representing the orientation of the conductive portions within the connector assembly. The diagram is of a cross-section taken through the two connectors 2 and 3 about halfway between, and parallel to, printed circuit boards 9 and 17. The dark rectangles are very simplified representations of cross sections of conductive portions.

FIG. 5 (Prior Art) is a perspective view of an improved connector assembly 18 that includes a male connector 19 and a female connector 20. Note that every second one of the solder tails in the two rows of solder tails on the upper surface of male connector 19 are electrically coupled together. Reference numeral 21 illustrates one such pair of solder tails that is formed as a bar or strip.

FIG. 6 (Prior Art) is a cross-sectional diagram of the connector assembly 18 of FIG. 5. The cross-section of FIG. 6 is taken through the connector assembly at the location of pair 21. Rather than there being two separate pins in the male connector 19 as in the case of FIG. 2, there is a single piece 22 of stamped metal that is inserted into insulative portion 23. Metal piece 22 has two solder tails 24 and 25 that are usable to solder the male connector 19 to a first printed circuit board 26. Rather than there being two separate metal inserts in the female connector 20 as in the case of FIG. 2, there is a single piece 27 of stamped metal that has two contact portions. Piece 27 has two solder tails 28 and 29 that are usable to solder female connector 20 to a second printed circuit board 30.

FIG. 7 (Prior Art) is a view taken at the same sectional line as FIG. 6, except that FIG. 7 shows the connector assembly structure when the two connectors 19 and 20 are mated. Note that the flexing contact portions 31 and 32 press inward and make electrical contact with metal piece 22. Note that a large portion of the cross-sectional area of the connector assembly in FIG. 7 is metal that is electrically coupled together.

FIG. 8 (Prior Art) is a cross-sectional view through the connector assembly 18, but the cross-section is taken through a pair of solder tails that are not joined together. The cross-section of FIG. 8 appears much like the cross-section of FIG. 2, except that the press fit extension portions on metal inserts 10 and 11 have been eliminated.

FIG. 9 (Prior Art) is a cross-sectional view taken in same plane as the cross-sectional view of FIG. 8, except that male connector 19 and female connector 20 are shown in the mated position. Contact portion 33 presses inward to the right on pin 34 thereby establishing a first conductive path through the connector assembly between solder tail 35 and solder tail 36. Similarly, contact portion 37 pressed inward to the left on pin 38 thereby establishing a second conductive path through the connector assembly between solder tail 39 and solder tail 40.

FIG. 10 (Prior Art) is a simplified diagram representing the orientation of the conductive portions within the connector assembly of FIG. 5. The diagram is of a cross-section taken through the two connectors 19 and 20 about halfway between, and parallel to, printed circuit boards 26 and 30. The dark rectangles represent cross sections of conductors. The longer rectangle 41 represents the conductive portions illustrated in FIGS. 6 and 7. These conductive portions are coupled to ground potential and form what approximates a ground plane that extends in the vertical dimension in FIG. 10. The smaller rectangles 42 and 43 represent the conductive portions in the plane of FIGS. 8 and 9. Rectangle 43 represents contact portion 37 and pin 38, whereas rectangle 43 represents contact portion 33 and pin 34. The conductors represented by rectangles 42 and 43 are used to conduct differential signals. Note that the topology of the ground portions and signal portions of FIG. 10 comes closer to a microstrip topology in that pairs of signal conductors are disposed side by side with respect to one another, and in that the pair of signal conductors are disposed over a ground plane. Because the topology of FIG. 10 is closer to that of a microstrip topology than is the topology of FIG. 4, the connector assembly of FIG. 5 can handle higher frequency signals that the connector assembly of FIG. 1. One example of a connector assembly that has a form similar to the form of the connector assembly of FIG. 5 is the so-called "Micro GigaCN stacking connector" from Fujitsu, model number FCN-260. The FCN-260 connector assembly is reported to be able to handle signals up to approximately three gigabits per second. A connector assembly is desired that can handle higher frequency signals.

SUMMARY

A connector assembly includes a male surface mount connector and a female surface mount connector. The female connector includes two printed circuit assembly portions (PCAPs). Each PCAP includes a printed circuit portion having a ground plane on one side and a plurality of strip-shaped conductors on the other side. A plurality of contact beam portions are attached to the strip-shaped conductors so that the PCAP structure resembles a comb having a ground plane in the backbone portion of the comb. Every third contact beam of a PCAP is coupled through the printed circuit of the PCAP to the ground plane. The pairs of contact beams between the grounded contact beams are used to communicate differential signals between the male and female connectors. The PCAPs are disposed in an insulative portion of the female connector such that the two rows of contact beams of the two PCAPs face one another.

The male connector also includes two PCAPs and an insulating portion that holds the two PCAPs. Each PCAP in the male connector has a ground plane on one side and a plurality of exposed conductors on the other side. Unlike the PCAPs in the female connector, the PCAPs in the male connector do not have contact beams. The PCAPs in the male connector are disposed such that the ground plane sides of the PCAPs are back-to-back and such that the exposed conductors are facing outwardly and away from one another.

When the male and female connectors are mated, the contact beams on the female connector make electrical contact with the exposed conductors on the PCAPs in the male connector. Electrical signals are communicated from a surface mount attachment feature (for example, a solder tail) on one of the connectors, through a contact beam to the other connector, and to a surface mount attachment feature (for example, a solder tail) on the other connector. Every third surface mount attachment feature and contact beam is coupled to ground potential and to ground planes in the four PCAPs of the connector assembly. Accordingly, the grounded conductors of the connector assembly form a set of shielded structures that represent tubes through which pairs of signal paths run from one connector to the other connector. When the connector assembly is considered in cross-section, the conductors of the assembly have a microstrip-like geometry of ground plane and pairs of signal conductors. The geometries, materials and electrical properties of the PCAPs in the male and female connectors are microstrip-like and may closely approximate the geometries, materials and electrical properties in the printed circuit boards from which the electrical original, and to which the electrical signals are conducted. The printed circuits of the PCAPs may be printed circuit boards.

In one embodiment, the characteristic impedance of a signal path through the mated connector assembly varies by less than plus or minus ten percent. At a signal rate of 22 gigahertz through the signal path, the insertion loss is better than −3 dB (the signal propagation down the signal path has degraded by less than −3 dB), and the return loss is better than −10 dB (the magnitude of reflections is less than −10 dB).

Other embodiments and advantages are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
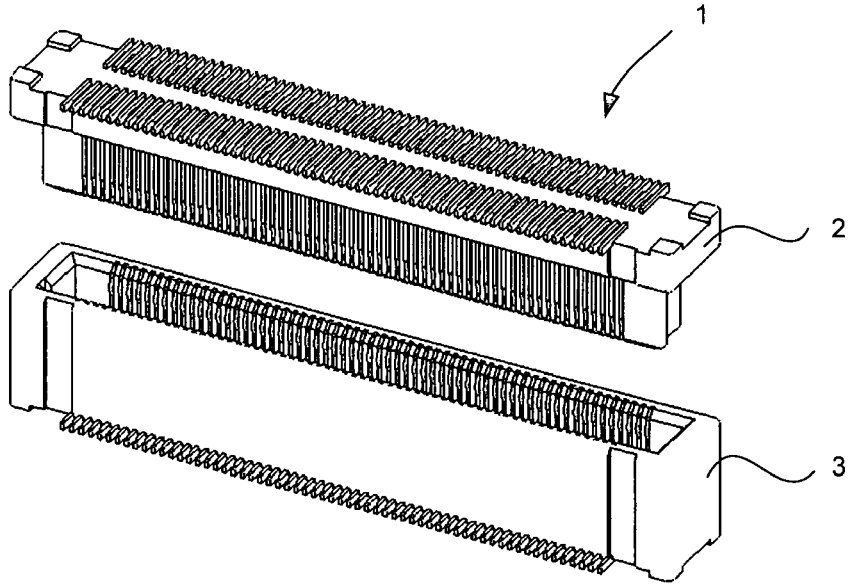
FIG. 1 PRIOR ART
FIGS. 1–3 (Prior Art) are views of a conventional stacked surface mount connector.
Figure 2:
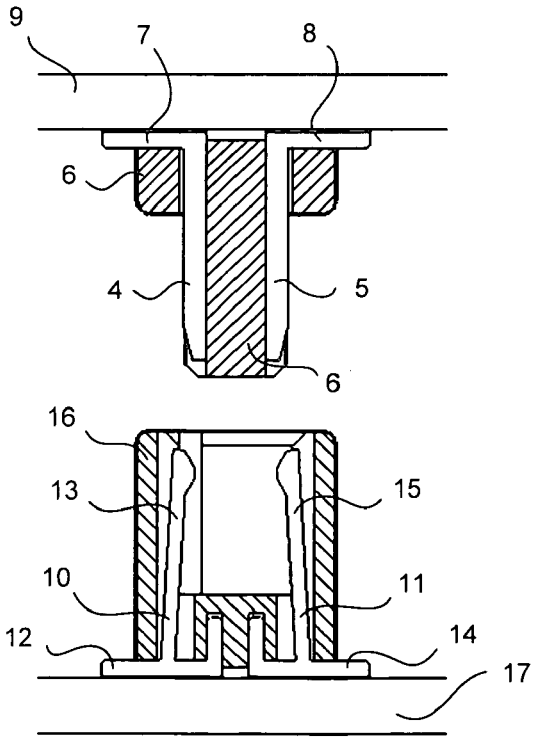
FIG. 2 PRIOR ART
Figure 3:
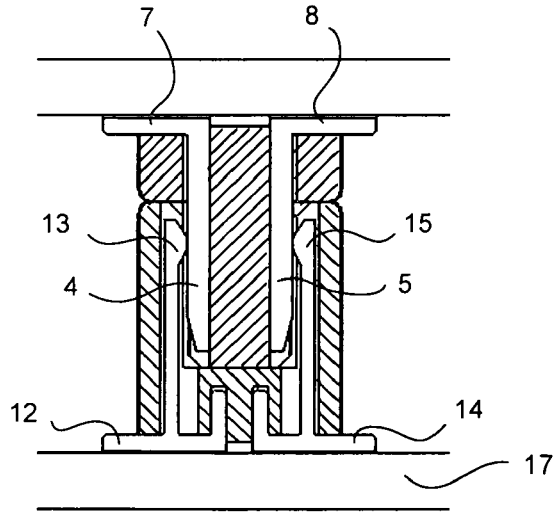
FIG. 3 PRIOR ART
Figure 4:
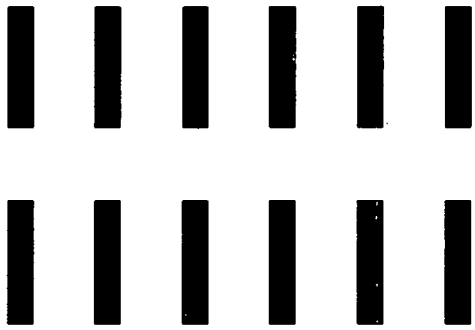
FIG. 4 PRIOR ART
FIG. 4 (Prior Art) is a simplified diagram that represents the geometries of conductors within the connector assembly of FIGS. 1–3.
Figure 5:
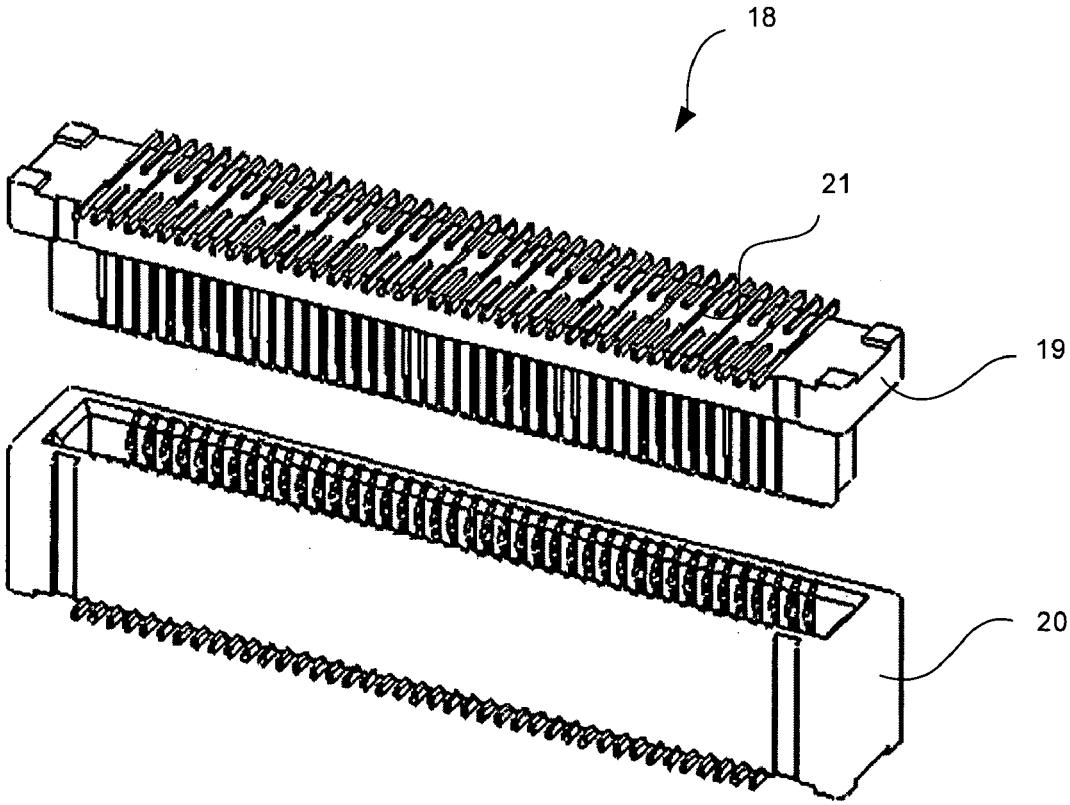
FIG. 5 PRIOR ART
FIGS. 5–9 (Prior Art) are views of an improved conventional stacked surface mount connector.
Figure 6:
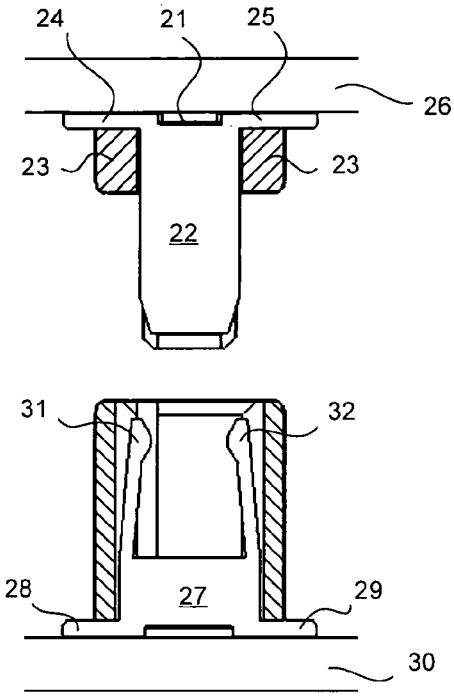
FIG. 6 PRIOR ART
Figure 7:
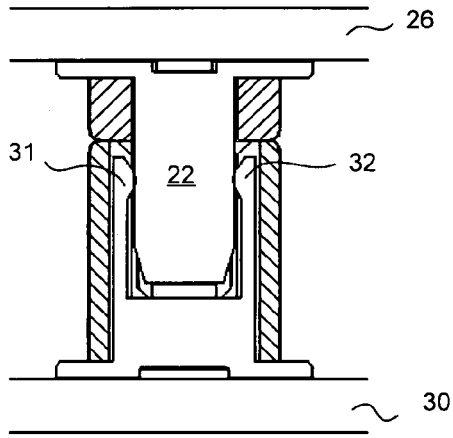
FIG. 7 PRIOR ART
Figure 8:
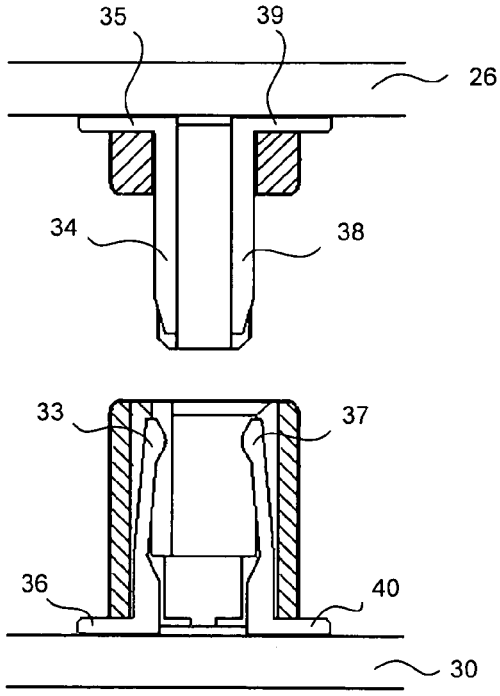
FIG. 8 PRIOR ART
Figure 9:
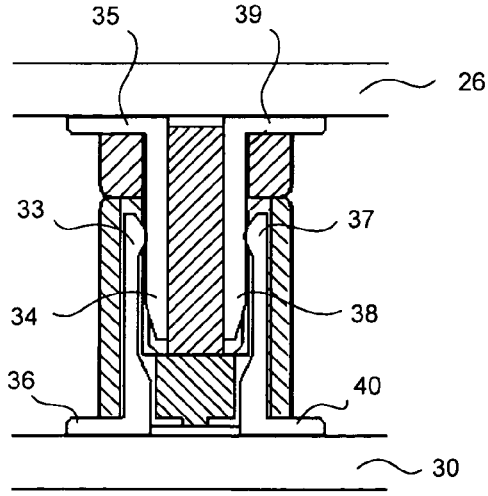
FIG. 9 PRIOR ART
Figure 10:
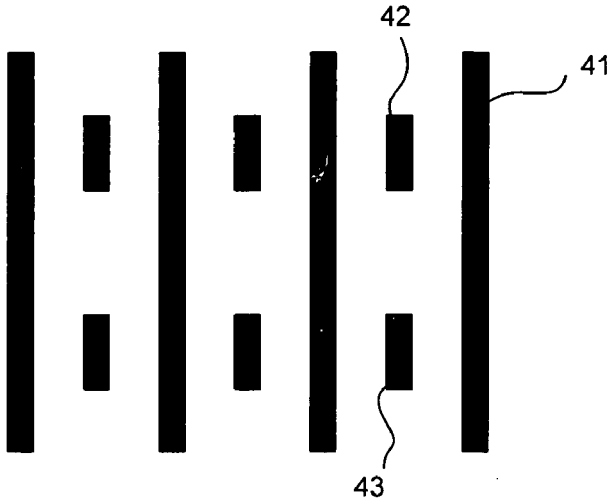
FIG. 10 PRIOR ART
FIG. 10 (Prior Art) is a simplified diagram that represents the geometries of conductors within the connector assembly of FIGS. 5–9.
Figure 11:
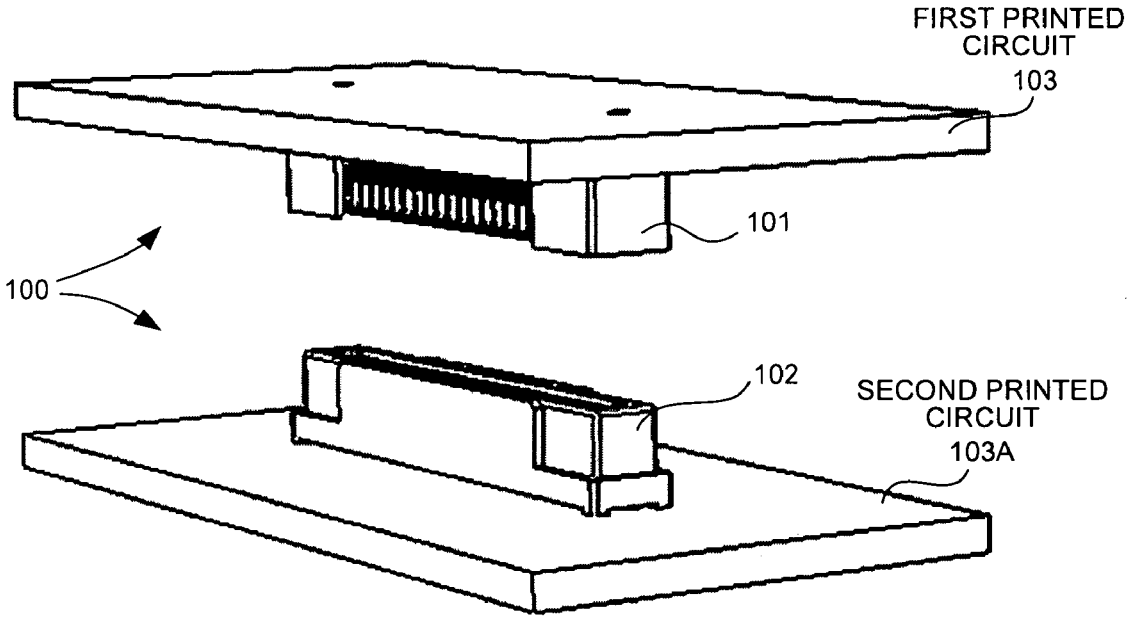
FIG. 11 is a perspective view of a novel connector assembly in accordance with the present invention.

FIG. 11 is a perspective view of a novel connector assembly 100. Connector assembly 100 includes a male connector 101 and a female connector 102. Male connector 101 is illustrated physically connected to a first printed circuit board 103. Female connector 102 is illustrated physically connected to a second printed circuit board 103A. The connectors 101 and 102 of the connector assembly 100 are usable to couple electrical conductors (for example, signal traces) in first printed circuit board 103, through the connector assembly (when mated), to electrical conductors (for example, signal traces) in second printed circuit board 103A.

Figure 12:
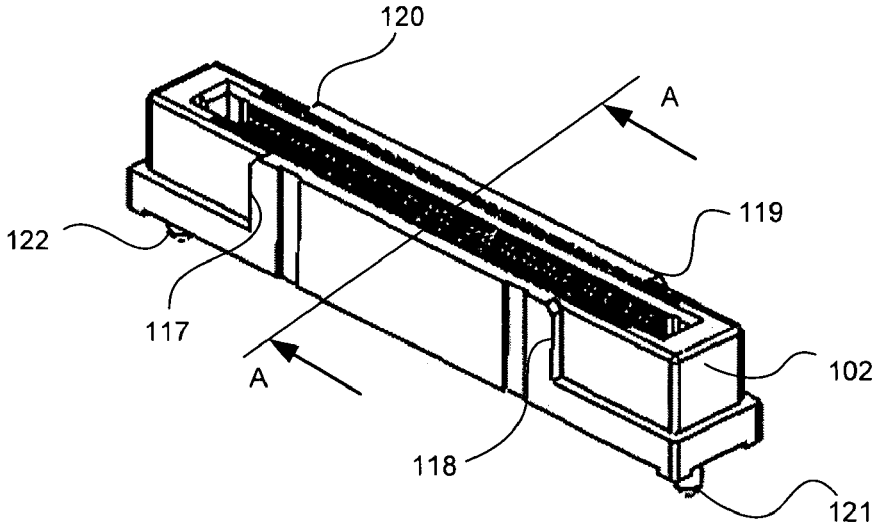
FIG. 12 is a perspective view of the female connector of the connector assembly of FIG. 11.

FIG. 12 is a more detailed perspective view of female connector 102.

Figure 13:
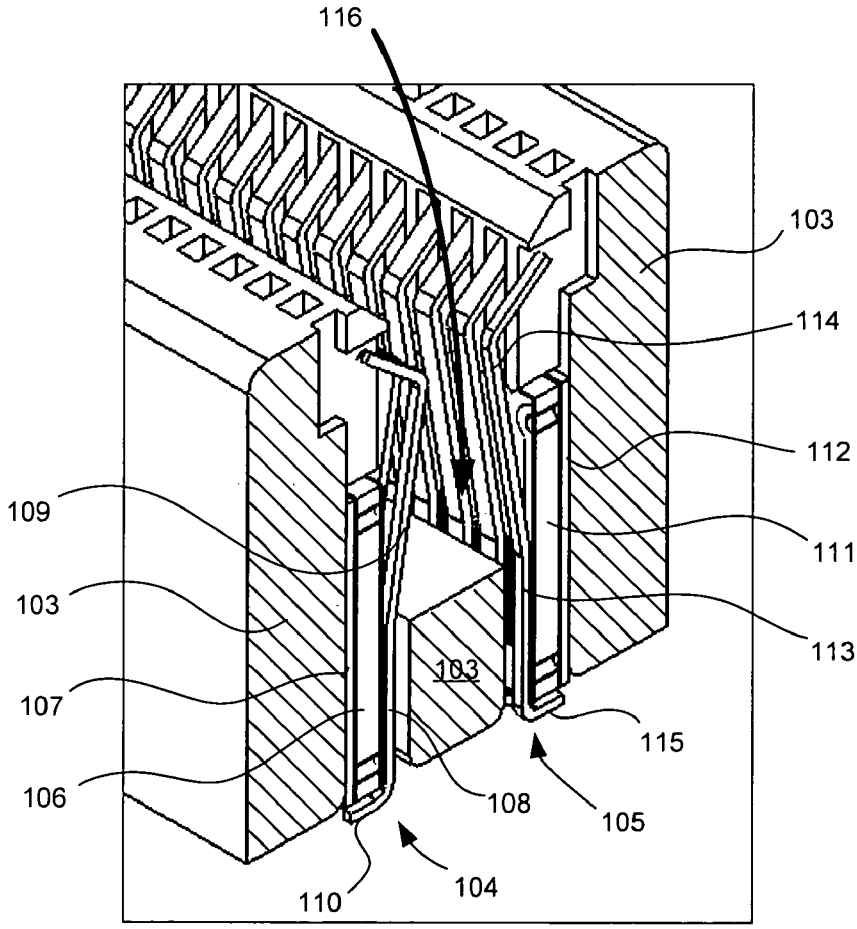
FIG. 13 is a cross-sectional view taken along line A—A in FIG. 12.

FIG. 13 is a detailed cross-sectional diagram taken along sectional line A—A in FIG. 12. Female connector 102 includes an insulative housing portion 103, a first printed circuit assembly portion (PCAP) 104, and a second PCAP 105. Insulative portion 103 may, for example, be made of Liquid Crystal Polymer (LCP) material that has a dielectric constant of approximately 3.5 to 4.0 and exhibits small mold shrinkage characteristics. First PCAP 104 includes a first printed circuit (PC) 106, a stiffener 107, and a plurality of contact beam portions. The contact beam portions are physically connected to first PC 106 so that the contact beam portions are all disposed parallel to one another as illustrated. Reference numeral 108 indicates one such contact beam portion. The upper portion of contact beam portion 108 is a flexible contact beam 109 that is bent to have the form illustrated. The lower portion of contact beam portion 108 is a surface mount attachment feature 110 (in this case, a solder tail).

Second PCAP 105 has an identical construction to the construction of PCAP 104. The first PCAP 104 and the second PCAP 105 are disposed in and are coupled to insulative housing portion 103 such that the contact beam portions on the respective first and second PCAPs 104 and 105 face one another as illustrated. Second PCAP 105 includes a second printed circuit (PC) 111, a stiffener 112, and a plurality of contact beam portions. The contact beam portions are physically connected to second PC 111 so that the contact beam portions are all disposed parallel to one another as illustrated. Reference numeral 113 indicates one such contact beam portion. The upper portion of contact beam portion 113 is a flexible contact beam 114. The lower portion of contact beam portion 113 is a surface mount attachment feature 115 (in this case, a solder tail). When the first and second PCAPs 104 and 105 are disposed in insulative housing portion 103, a male connector receiving slot (MCRS) 116 is formed between the facing contact beam portions of the PCAP 104 and the contact beam portions of the PCAP 105. As illustrated in FIG. 12, insulative housing portion 103 includes polarization guide structures 117–120 that prevent the male connector 101 from being inserted into the female connector 102 unless the male and female connectors are oriented with respect to one another in a proper end-to-end orientation. Peg-like extension features 121 and 122 on the bottom of insulative housing 103 stick down into corresponding receiving holes in printed circuit board 103A to align the female connector 102 on the printed circuit board 103A and to provide mechanical strength.

Figure 14:
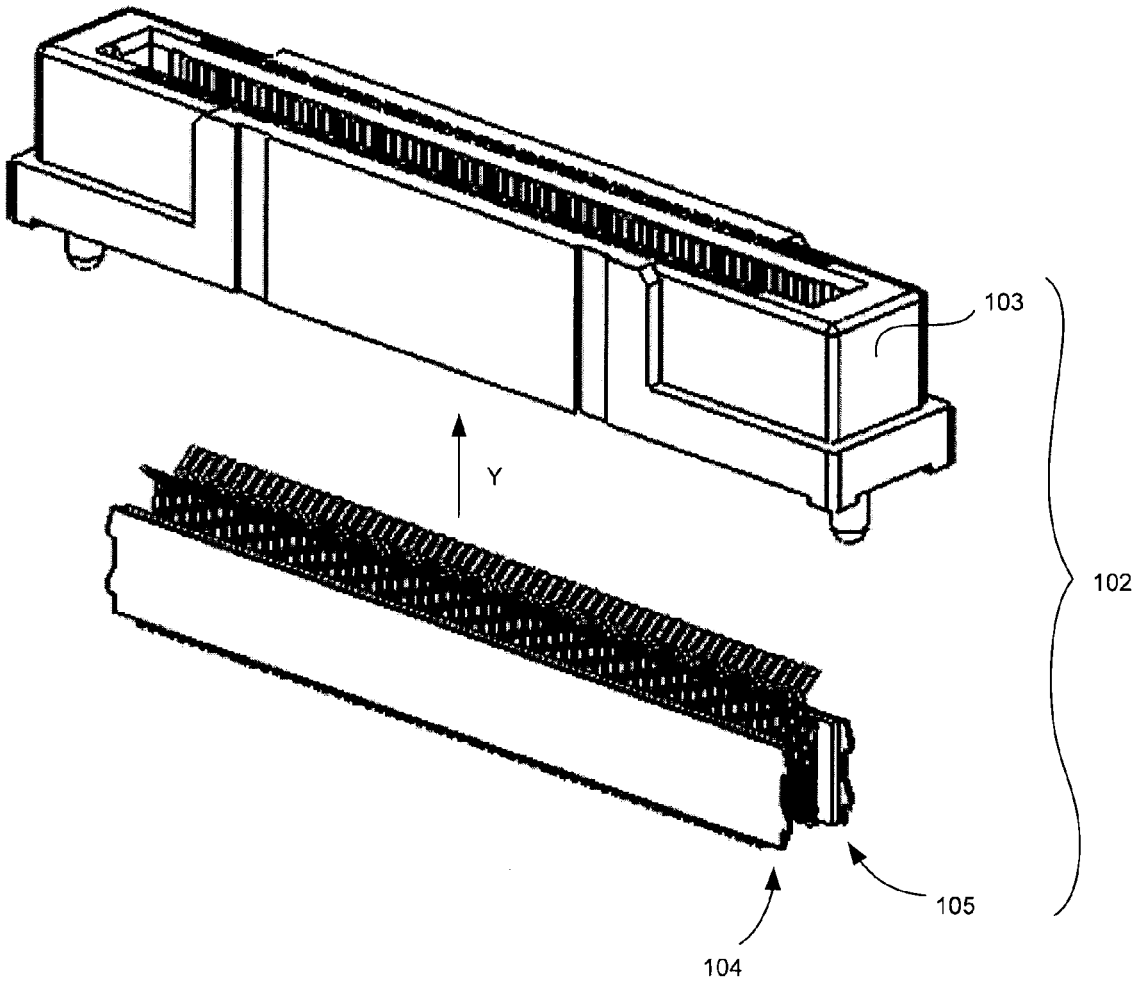
FIG. 14 is an exploded view of the female connector of FIG. 11.

FIG. 14 is an expanded exploded view of female connector 102. The first and second PCAPs 104 and 105 are shown underneath an outside of insulative housing portion 103. During assembly, each PCAP is inserted up in direction Y into a corresponding receiving slit in the bottom of insulative housing portion 103.

Figure 15:
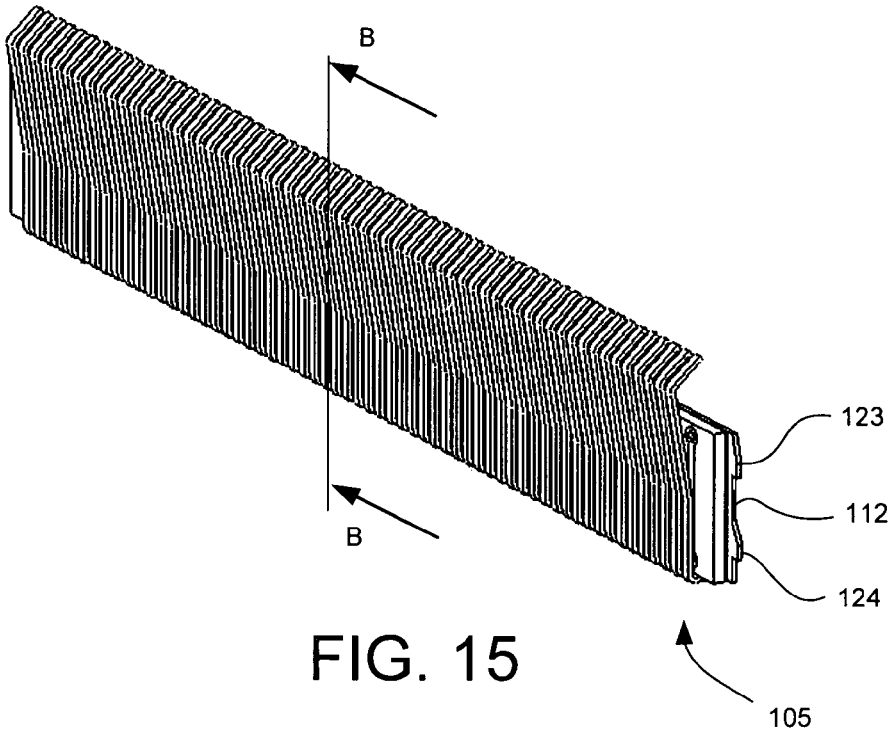
FIG. 15 is a diagram of one of the printed circuit assembly portions (PCAPs) of the female connector of FIG. 11.

FIG. 15 is an expanded view of second PCAP 105. The side edges (on the small sides of the rectangle) of stiffener 112 include downward pointing anchoring barbs. Two such barbs 123 and 124 are illustrated in FIG. 15. During connector assembly, the PCAP 105 is pushed up into the receiving slit until the barbs on the stiffener 112 snap into corresponding retaining openings in the sides of the receiving slit. The bards hold the PCAP 105 in place.

Figure 16:
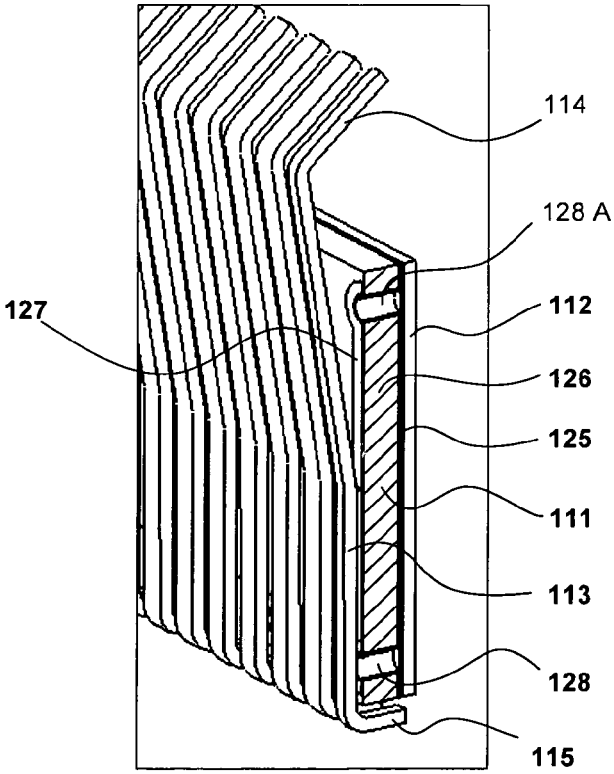
FIG. 16 is an expanded cross-sectional view taken along line B—B in FIG. 15.

FIG. 16 is an expanded cross-sectional view taken along sectional line B—B in FIG. 15. Second printed circuit 111 includes a conductive ground plane 125 that is on the surface of printed circuit 111 that faces stiffener 112. A layer of insulative solder mask separates ground plane 125 from stiffener 112. The stiffener 112 may, for example, be fixed by adhesive to second printed circuit 111. Second printed circuit 111 also includes an insulative substrate dielectric material 126 such as a fiberglass epoxy material commonly used to make printed circuit boards. Second printed circuit 111 also includes a plurality of strip-shaped conductors that are disposed on the surface of printed circuit 111 that faces the contact beam portions. Reference numeral 127 indicates one such strip-shaped conductor in the cross-sectional view of FIG. 16. Each contact beam portion is physically and electrically coupled to a corresponding one of the strip-shaped conductors on the printed circuit. The contact beam portions can, for example, be soldered to or brazed to the strip-shaped conductors. Contact beams portion 113 in the cross-sectional view of FIG. 16 is a ground contact beam portion as opposed to a contact beam portion that is used to communicate signals. The strip-shaped conductor 127 to which contact beam portion 113 is attached is coupled through printed circuit 111 by conductive through holes 128 and 128A to ground plane 125. Although not illustrated in FIG. 16, first PCAP 104 has an identical construction to the construction of second PCAP 105 illustrated in FIG. 16.

Figure 17:
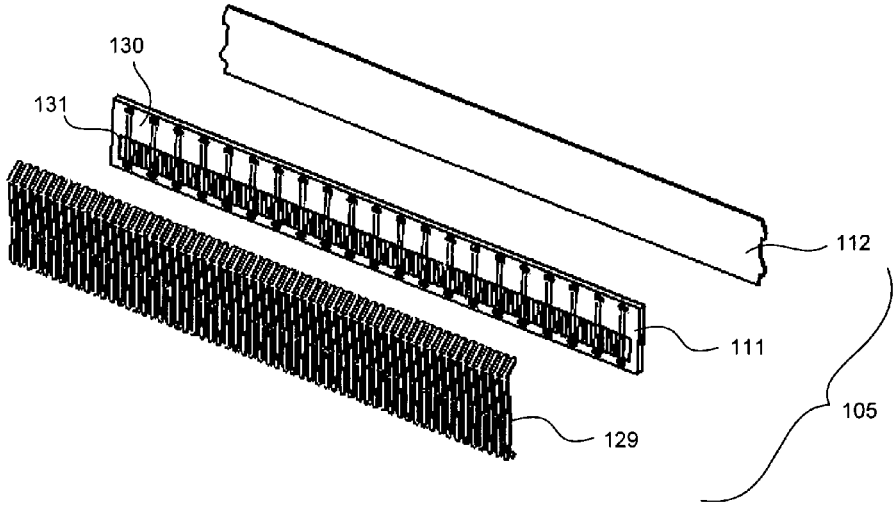
FIG. 17 is an exploded view of the PCAP of FIG. 16. The PCAP is made by fixing the printed circuit to the stiffener using an adhesive. A comb-shaped structure is stamped out of rigid metal to form a set of contact beam portions that extend from a backbone of the comb structure. The ends of the contact beams are then bent to have the desired shape of the contact beams as illustrated in FIG. 16. The formed comb-shaped structure is then soldered or brazed to exposed conductors on the exposed surface of the printed circuit. The backbone portion of the comb-shaped structure is then cut off, leaving short ends of the contact beams. These short ends are then bent to form solder tails of the shape illustrated in FIG. 16. After this process, each contact structure is a separate strip of stamped metal that is fixed to the printed circuit.

FIG. 17 is an exploded view of second PCAP 105 showing metal stiffener 112, second printed circuit 111, and the plurality of contact beam portions 129 that are connected to the second printed circuit 111. Note that the face of second printed circuit 111 to which the contact beam portions 129 are connected has a solder mask layer that covers the face illustrated in FIG. 17, but for a longitudinal rectangular window 131 of the printed circuit that is not covered with solder mask. Where the contact beam portions 129 are soldered to or brazed to the strip-shaped conductors on printed circuit 111, the sold or brazed connection is made in the window area where no solder mask layer 130 is present.

Figure 18:
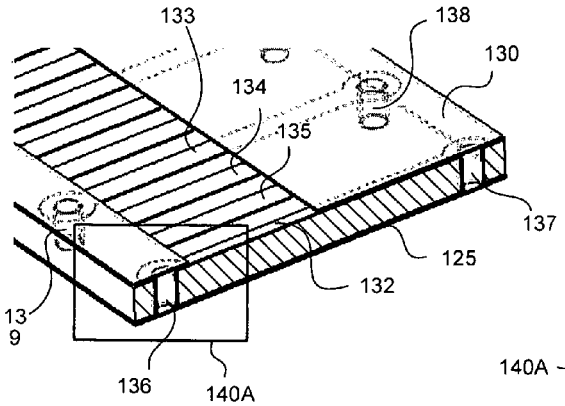
FIG. 18 is a more detailed diagram of a portion of the printed circuit of the PCAP of FIG. 17.

FIG. 18 is an expanded cross-sectional view of second printed circuit 111. Every third strip-shaped conductor is a ground conductor that is longer than the intervening pair of shorter strip-shaped conductors used to communicate signals. Reference numerals 132 and 133 indicate two such longer strip-shaped ground conductors. The pair of shorter strip-shaped conductors 134 and 135 are used to conduct differential signals whereas the longer strip-shaped conductors 132 and 133 are ground conductors. The cross-sectional view of FIG. 18 illustrates the exposed portions of the strip-shaped conductors within window 131 to which the contact beam portions are attached. The conductive through holes that electrically couple the longer strip-shaped ground conductors 132 and 133 to the ground plane 125 on the opposite side of second printed circuit 111 are indicated by reference numerals 136–139.

Figure 19:
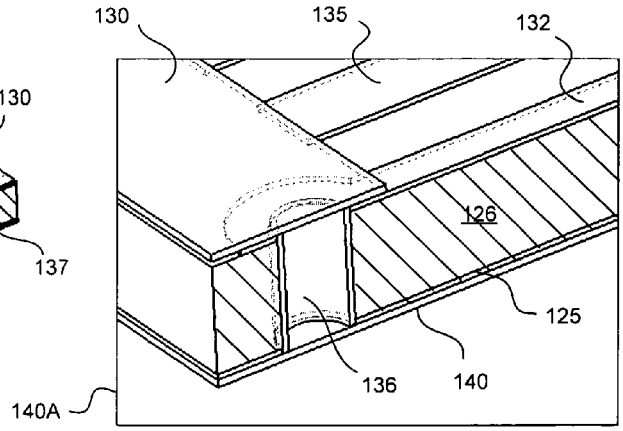
FIG. 19 is a more detailed diagram of a portion of the printed circuit of FIG. 18.

FIG. 19 is an expanded view of the conductive through hole 136 in the box 140A of FIG. 18. Conductive through hole 136 electrically couples long strip-shaped conductor 132 on one side of second printed circuit 111 to ground plane 125 on the opposite side of second printed circuit 111. The ground plane 125 is covered by a layer of solder mask 140 that insulates ground plane 125 from metal stiffener 112. Metal stiffener 112 is, in one embodiment, a fairly rigid and strong piece of metal that is stamped out of a sheet of metal. Stiffener 112 is not grounded in this embodiment but rather is electrical isolated (floating).

Figure 20:
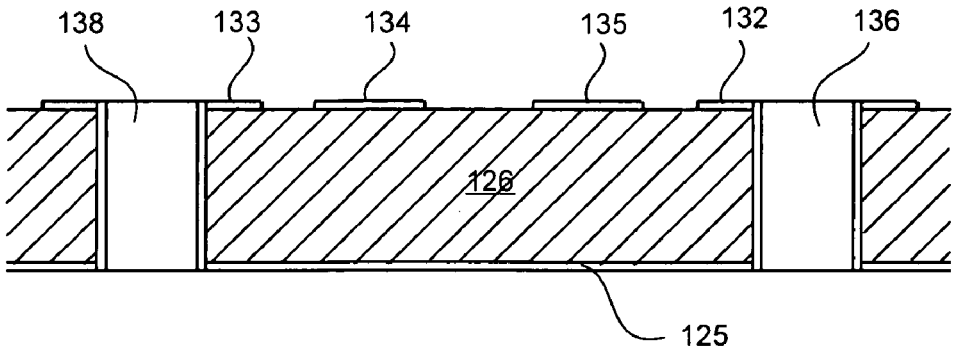
FIG. 20 is a simplified cross-sectional diagram that illustrates the microstrip-like structure of the conductors within the printed circuit of the PCAP of FIG. 18.

FIG. 20 is a simplified cross-sectional view of the structure of second printed circuit 111. The strip-shaped signal conductors 134 and 135 are disposed side-by-side between a pair of longer strip-shaped ground conductors 133 and 132. A ground plane 125 underlies the entire structure. The structure therefore has a topology that resembles a microstrip design. In one embodiment, the dimensions and spacings and materials of the conductors 125, 132–135 and dielectric material 126 are similar to the conductor and dielectric dimensions and spacings within printed circuit board 103A. Because the geometries and electric properties of the materials through which an electrical signal passes from a trace in printed circuit board 103A and into and through a conductor in female connector 102 are similar, the characteristic impedance along the entire signal path is made to vary by less than plus or minus ten percent. This uniformity in characteristic impedance is desirable and minimizes unwanted reflections.

Figure 21:
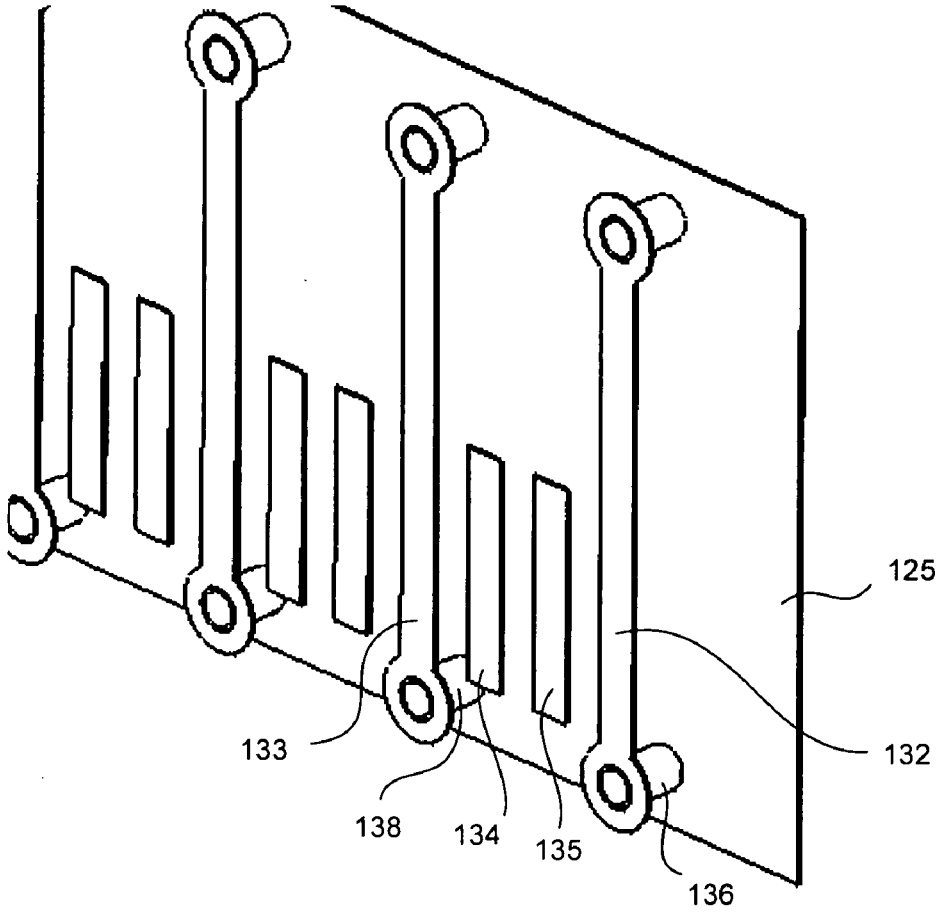
FIG. 21 is a perspective view of a portion of the printed circuit of FIG. 18 with the dielectric and solder mask layers not shown.

FIG. 21 is a perspective view of a portion of second printed circuit 111. The dielectric material and solder mask layers are not illustrated in order to make the strip-shaped conductors, the conductive through holes, and the ground plane less obscured.

Figure 22:
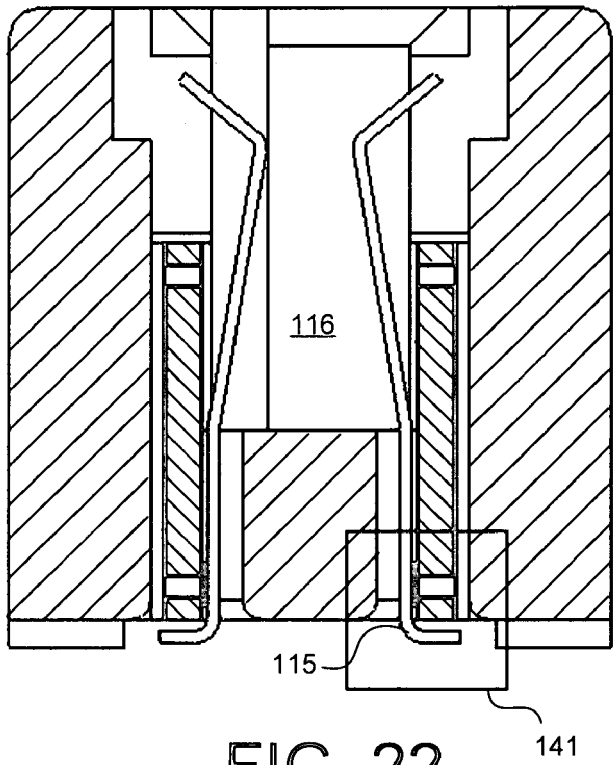
FIG. 22 is a cross-sectional diagram of the female connector of FIG. 11.

FIG. 22 is a cross-sectional diagram of female connector 102 taken along line A—A of FIG. 12. Volume 116 is the male connector receiving slot (MCRS) into which a portion of male connector 101 fits when male connector 101 is mated to female connector 102.

Figure 23:
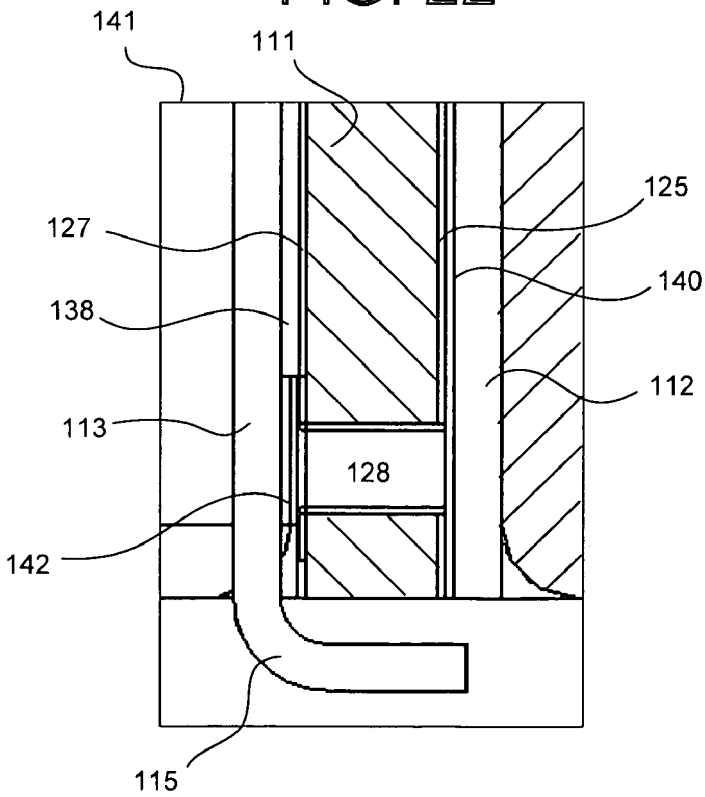
FIG. 23 is an expanded view of a portion of the female connector of FIG. 22.

FIG. 23 is an expanded view of box 141 of FIG. 22. In the example of FIG. 23, the surface mount attachment feature 115 is a solder tail extension of contact beam portion 113. The detail of second printed circuit 111 and stiffener 112 is illustrated. To realize the microstrip design topology, contact beam portion 113 is electrically coupled by conductive through hole 128 to ground plane 125. Volume 142 between contact beam portion 113 and the exposed portion of ground conductor 127 (the portion not covered by solder mask) is filled with solder or brazing material that connects the contact beam portion 113 to strip-shaped conductor 127.

Figure 24:
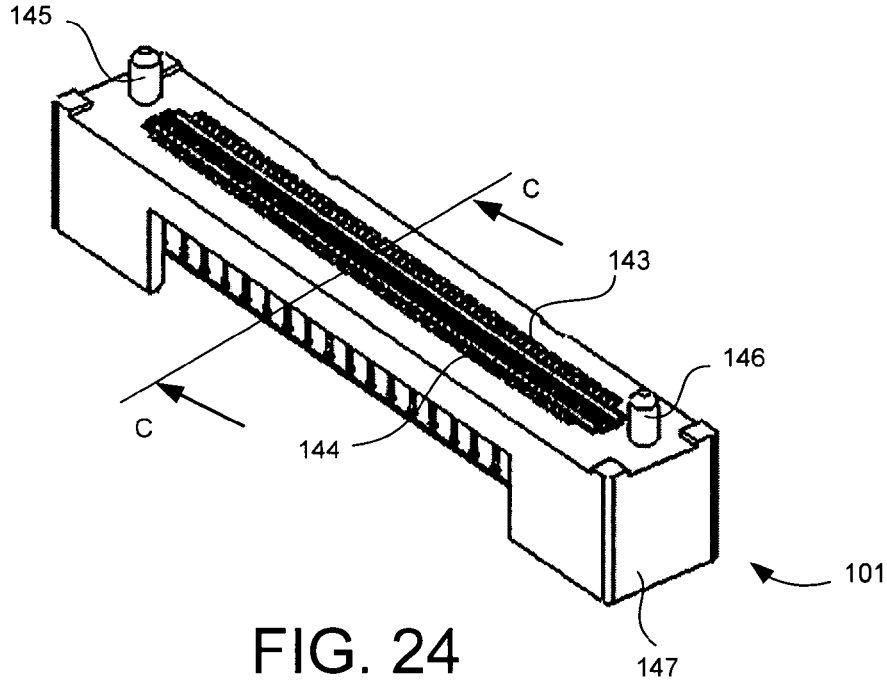
FIG. 24 is a perspective view of the male connector of FIG. 11.

FIG. 24 is a perspective view of male connector 101. Like female connector 102, male connector 101 has surface mount attachment structures (in this case, solder tails) by which the connector is connected to printed circuit board 103. The surface mount attachment features appear as two rows 143 and 144. Peg-like extension features 145 and 146 on insulative portion 147 stick up into corresponding receiving holes in printed circuit board 103 to align male connector 101 on printed circuit board 103 and to provide mechanical strength.

Figure 25:
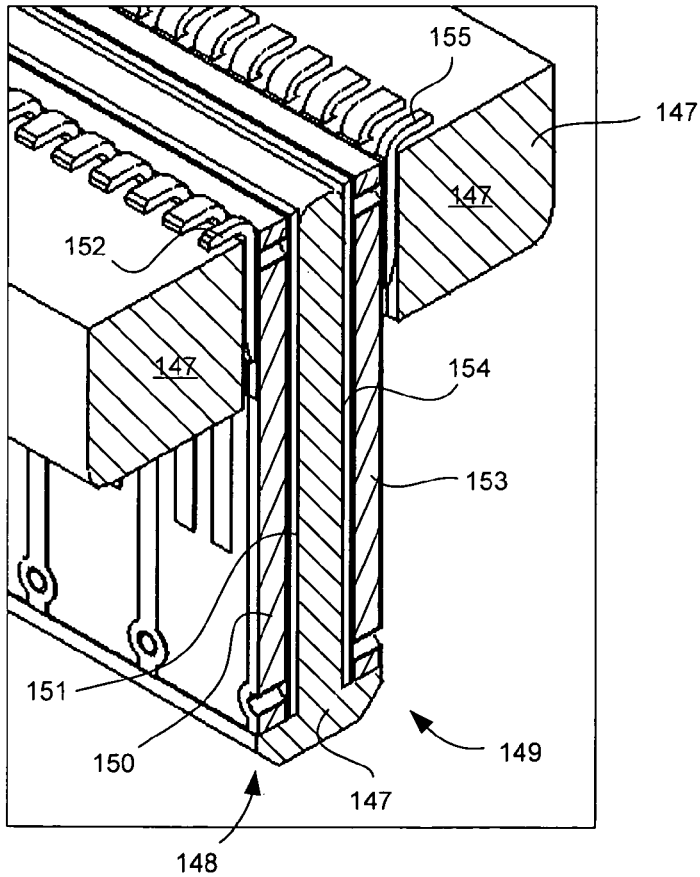
FIG. 25 is a cross-sectional diagram taken along line C—C in FIG. 24.

FIG. 25 is an expanded cross-sectional perspective view of male connector 101 taken along sectional line C—C in FIG. 24. Male connector 101 includes an insulative portion 147, a first printed circuit assembly portion (PCAP) 148, and a second PCAP 149. First PCAP 148 includes a fist printed circuit 150, a plurality of surface mount attachment features (in this case, solder tails), and a stiffener 151. One of the solder tails is indicated by reference numeral 152. The second PCAP 149 is of identical construction to the first PCAP 148. The second PCAP 149 includes a second printed circuit 153, a plurality of surface mount attachment features (in this case, solder tails), and a stiffener 154. One of the solder tails is indicated by reference numeral 155. The first and second PCAPs 148 and 149 are disposed in back to back relation as illustrated such that the stiffener portions of the PCAPs 148 and 149 face one another, and such that the solder tails of the two PCAPs 148 and 149 flare outwardly and extend away from one another.

Figure 26:
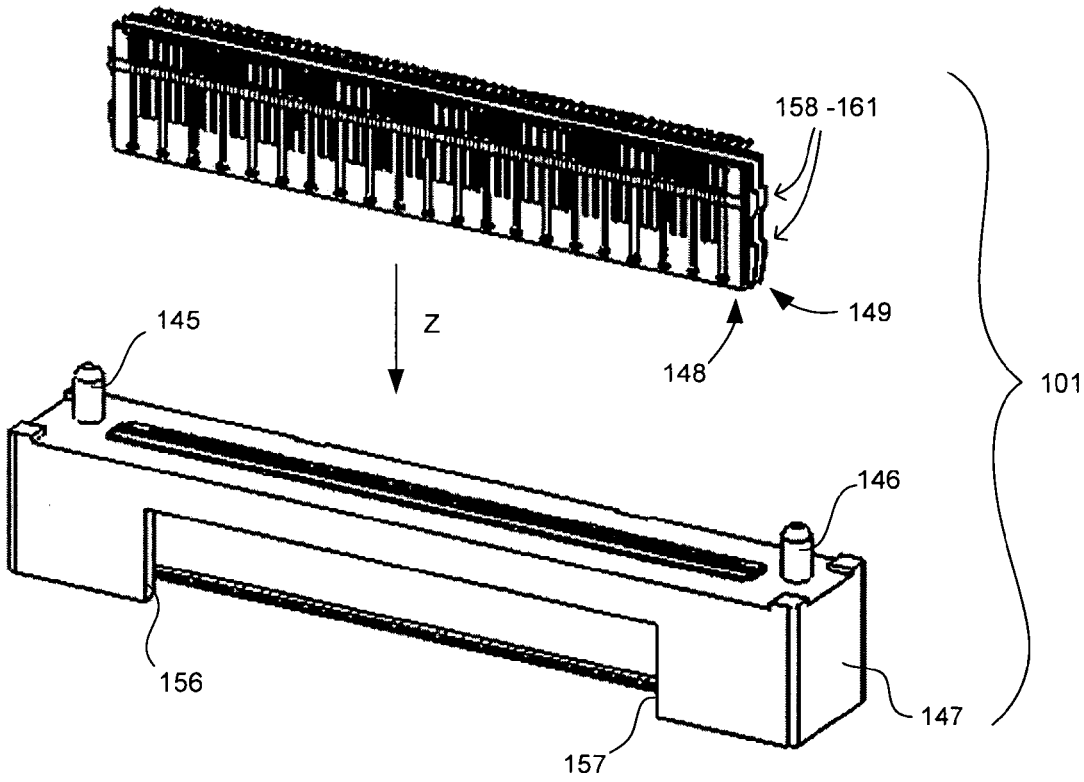
FIG. 26 is an exploded view of the male connector of FIG. 24.

FIG. 26 is an exploded view of male connector 101. The first and second PCAPs 148 and 149 are shown outside of insulative portion 147. Like insulative portion 103, insulative portion 147 is made of Liquid Crystal Polymer (LCP) material. Insulative portion 147 has polarization guide structures 156 and 157 (two other polarization guide structures are on other hidden side of insulative portion 147) that prevent the male connector 101 from being inserted into the female connector 102 unless the male and female connectors are oriented with respect to one another in a proper end-to-end orientation. When male connector 101 is assembled, the first and second PCAPs 148 and 149 are slid down in direction Z into corresponding receiving slits in insulative housing 147. The stiffeners of the first and second PCAPs 148 and 149 have barbs (for example, see barbs 158–161) that are used to anchor the PCAPs 148 and 149 in place in insulative portion 147 in the same way that the barbs are used to anchor the PCAPs 104 and 105 in place in the insulative housing 103 of female connector 102 as described above.

Figure 27:
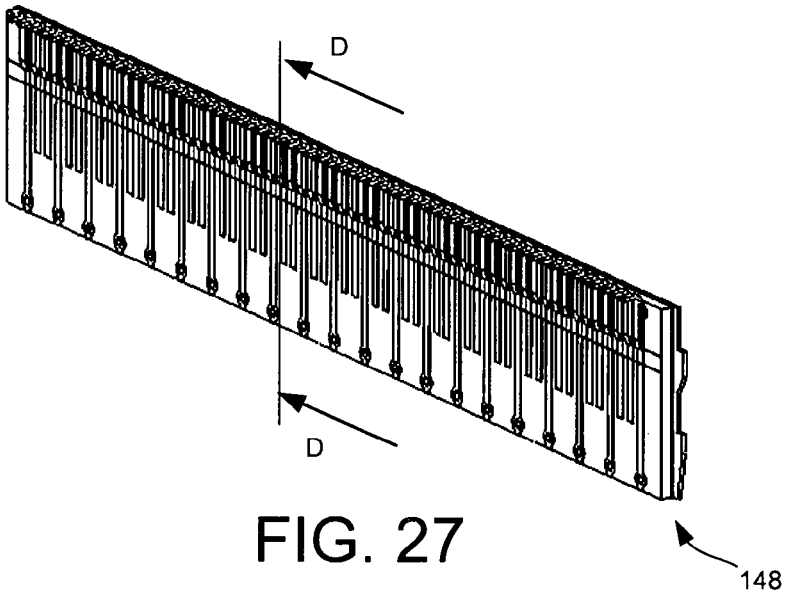
FIG. 27 is a view of one of the PCAPs of the male connector of FIG. 24.

FIG. 27 is a perspective view of first PCAP 148.

Figure 28:
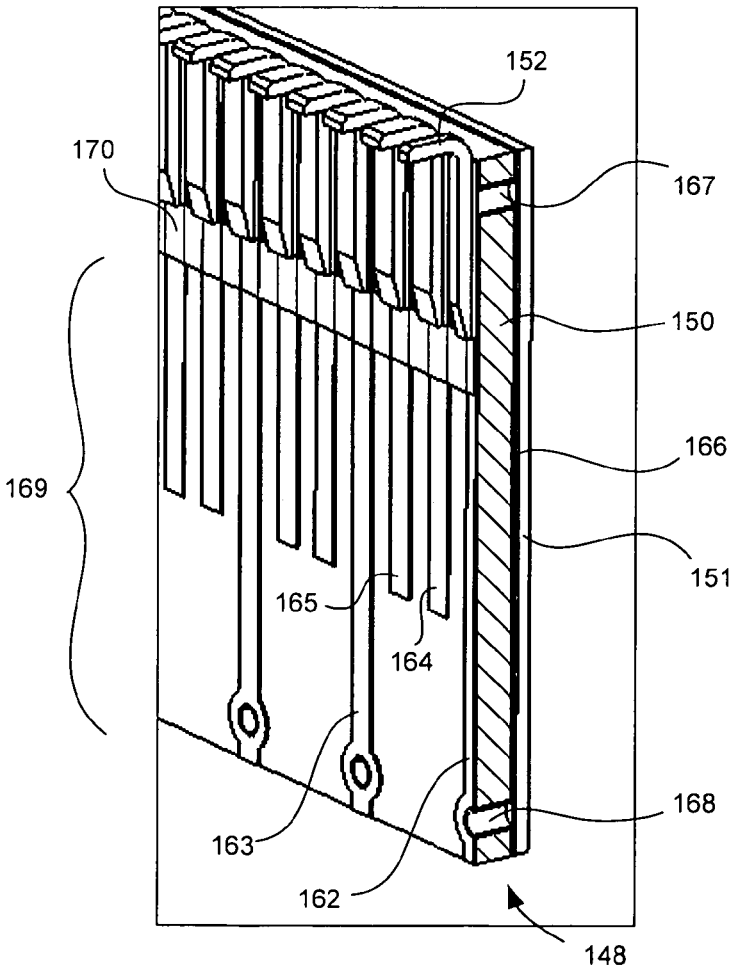
FIG. 28 is an expanded cross-sectional view taken along line D—D in FIG. 27.

FIG. 28 is an expanded cross-sectional perspective view of first PCAP 148 taken along sectional line D—D of FIG. 27. In the same way that the printed circuits in the female connector have longer strip-shaped ground conductors and shorter intervening strip-shaped signal conductors, so too does first PCAP 148 have longer strip-shaped ground conductors 162 and 163 and intervening shorter strip-shaped signal conductors 164 and 165. A ground plane 166 is disposed on the back side of printed circuit 150 and this ground plane is connected to the longer strip-shaped ground conductors by conductive through holes. Two such conductive through holes are indicated by reference numerals 167 and 168. A solder mask layer on the backside of first printed circuit 150 separates the ground plane 166 from the stiffener 151. The bottom portion 169 of the front side of first printed circuit 150 is not covered by solder mask so that the contact beams of the first PCAP 104 of female connector 102 can engage and make contact with the conductors in this area when the male and female connectors are mated. A solder mask layer 170 is disposed on the upper part of the front side of first printed circuit 150 with defined openings where the solder tails are soldered or brazed to the printed circuit 150.

Figure 29:
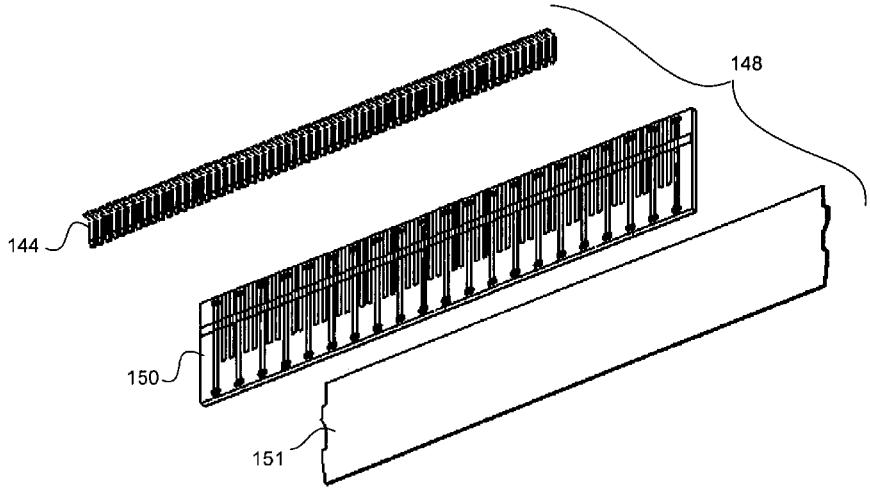
FIG. 29 is an exploded view of one of the PCAPs of the male connector of FIG. 29.

FIG. 29 is an exploded view of first PCAP 148 showing row 144 of solder tails, first printed circuit 150 and stiffener 151.

Figure 30:
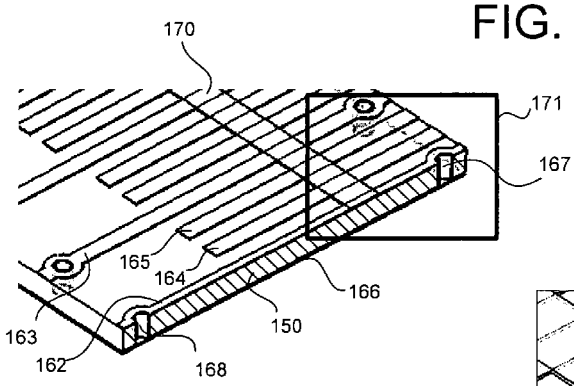
FIG. 30 is an expanded view of a portion of the printed circuit within the PCAP of FIG. 29.

FIG. 30 is an expanded cross-sectional view of a portion of first printed circuit 150. Note that the longer strip-shaped ground conductors 162 and 163 are coupled by conductive through holes to the ground plane 166 on the back side of first printed circuit 150.

Figure 31:
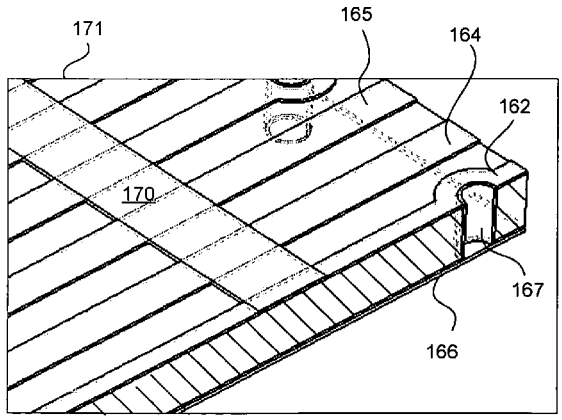
FIG. 31 is an expanded view of a portion of the printed circuit of FIG. 30.

FIG. 31 is an expanded view of the portion of first printed circuit 150 in box 171 of FIG. 30.

Figure 32:
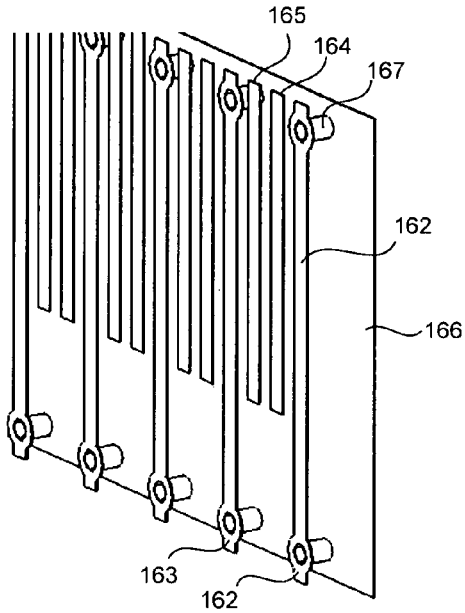
FIG. 32 is a perspective view of a portion of the printed circuit of FIG. 31 with the dielectric layer and the solder mask layers not shown.

FIG. 32 is a perspective cross-sectional view of first printed circuit 150 with the dielectric and solder mask layers not shown so that the conductive portions of the structure can be more easily seen.

Figure 33:
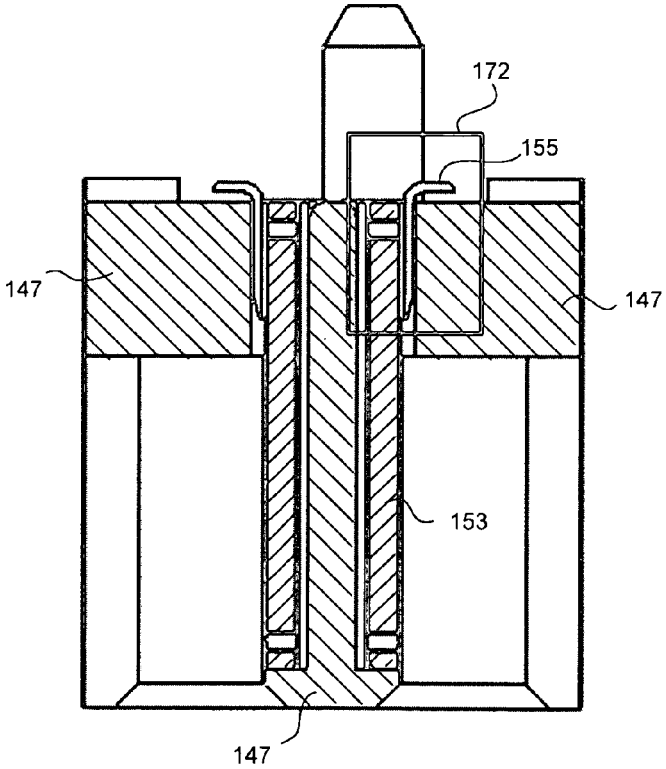
FIG. 33 is a cross-sectional diagram of the male connector of FIG. 24.

FIG. 33 is an expanded cross-sectional view of male connector 101 taken along line C—C in FIG. 24.

Figure 34:
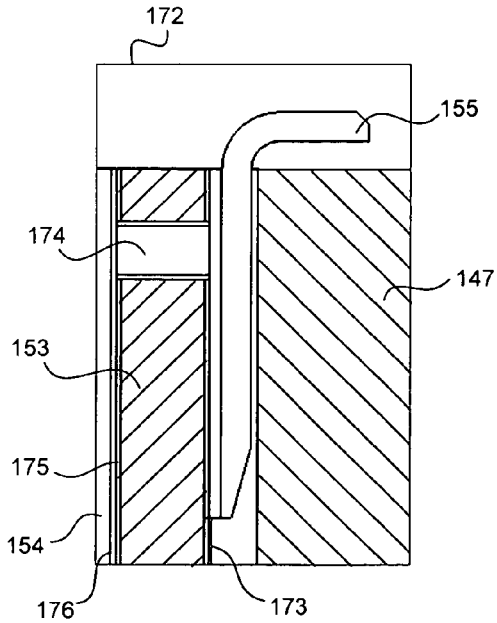
FIG. 34 is an expanded view of a portion of the male connector of FIG. 33.

FIG. 34 is an expanded view of the portion of male connector 101 in box 172 of FIG. 33. Solder tail 155 is soldered to or is brazed to second printed circuit 153. Solder tail 155 is coupled to a longer strip-shaped ground conductor 173, so solder tail 155 is electrically coupled by a conductive through hole 174 to the ground plane 175 on the back side of second printed circuit 153. A solder mask layer 176 separates ground plane 175 from metal stiffener 154. Stiffener 154 is a piece of rigid metal that is stamped out of a larger sheet of rigid metal. Although FIG. 34 shows a cross-section of a ground conductor and associated solder tail where the solder tail is electrically coupled to the ground plane, there are other signal conductors and associated solder tails that are not coupled to the ground plane.

Figure 35:
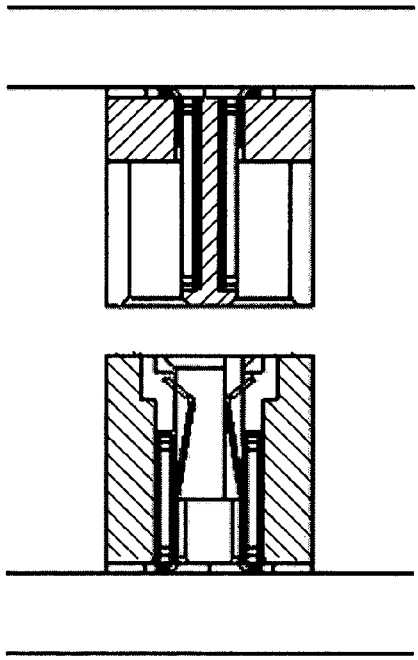
FIG. 35 illustrates the male and female connectors of the connector assembly of FIG. 11 before mating.

FIG. 35 is a cross-sectional diagram showing male connector 101 and female connector 102 before mating. The contact beams of the female portion 102 are not flexed outward.

Figure 36:
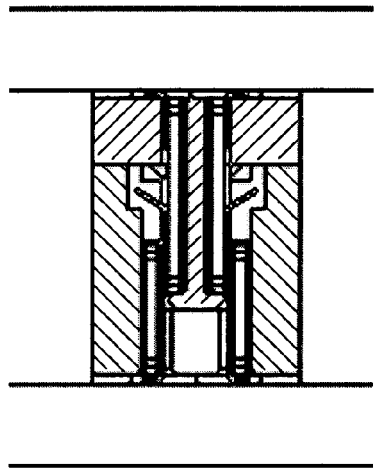
FIG. 36 illustrates the male and female connectors of the connector assembly of FIG. 11 after mating.

FIG. 36 is a cross-sectional diagram showing male connector 101 and female connector 102 after mating. A portion of male connector 101 is disposed in the male connector receiving slot (MCRS) 116. The contact beams of first PCAP 104 of female connector 102 press to the right and make electrical contact with corresponding ones of the strip-shaped conductors of first PCAP 148 of male connector 101. The contact beams of second PCAP 105 of female connector 102 press to the left and make electrical contact with corresponding ones of the strip-shaped conductors of second PCAP 149 of male connector 101. The contact beams of the female connector therefore press on both sides of the male connector.

Figure 37:
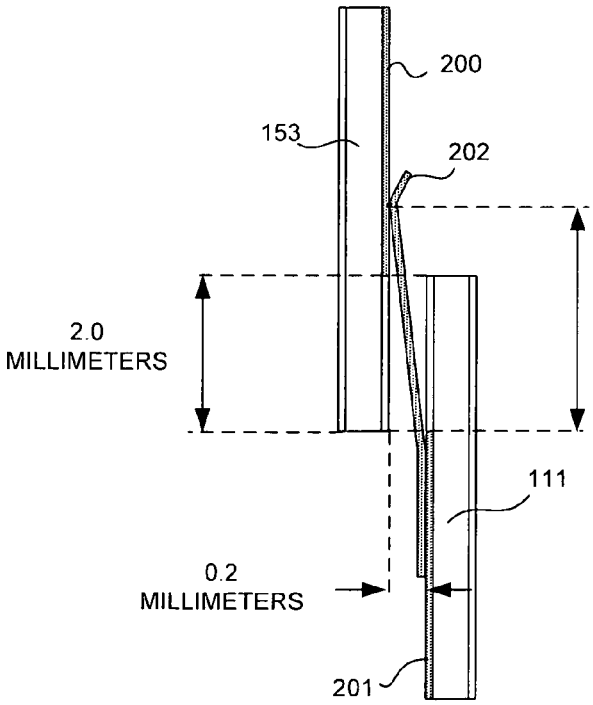
FIG. 37 is a simplified cross-sectional diagram that illustrates a part of a signal path through the connector assembly of FIG. 11. The signal path illustrated is one of two signal paths that is used to conduct a single differential signal.

FIG. 37 is a simplified cross-sectional diagram showing strip-like conductors 200 and 201 and contact beam 202 that cooperate to form a signal path through the connector assembly 100. The printed circuits 111 and 153 overlap one another by approximately 2.0 millimeters. The contact beam length is approximately 3.0 millimeters. The separation between to two printed circuits 111 and 153 is approximately 0.2 millimeters. Note that the shorter strip-shaped signal conductors stop short of the ends of the printed circuits 111 and 153 by the amount of printed circuit overlap (2.0 millimeters in this example).

Figure 38:
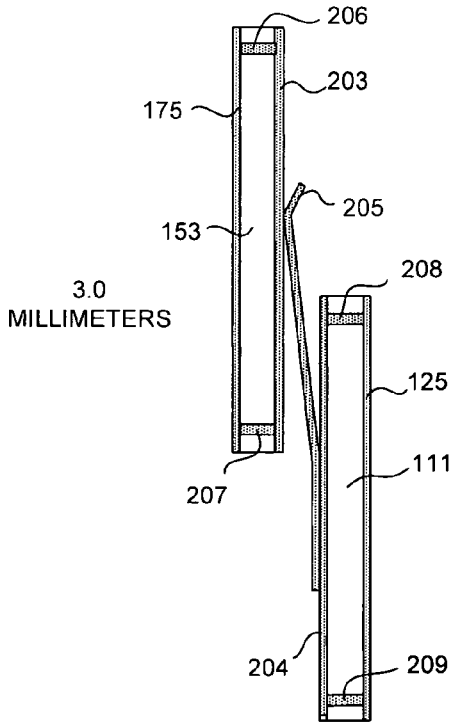
FIG. 38 is a simplified cross-sectional diagram that illustrates a set of inter-coupled and grounded conductors that forms a sort of grounded shield in the plane of the diagram. There is one such grounded shield that separates every successive pair of signal conductor structures of the type illustrated in FIG. 37. The ground planes of the grounded structure of FIG. 38 extend into the plane of the diagram.

FIG. 38 is a simplified cross-sectional diagram showing longer strip-like ground conductors 203 and 204, ground planes 175 and 125, and contact beam 205 that cooperate to form a shielding ground plane structure through and across the connector assembly 100. The printed circuits 111 and 153 overlap one another by the same dimensions in FIG. 38 as in FIG. 37. Note that the longer strip-shaped ground conductors extend all the way to the ends of the printed circuits 111 and 153 so that grounded conductors will cover a side of the contact beam 202 of FIG. 37 used to conduct a signal. Also note that the longer strip-shaped ground conductors are coupled by conductive through holes 206–209 to ground planes 175 and 125. The grounded conductive structures of FIG. 38 form a sort of shield around a tubular volume through which differential pairs of signals conductors extend.

Figure 39:
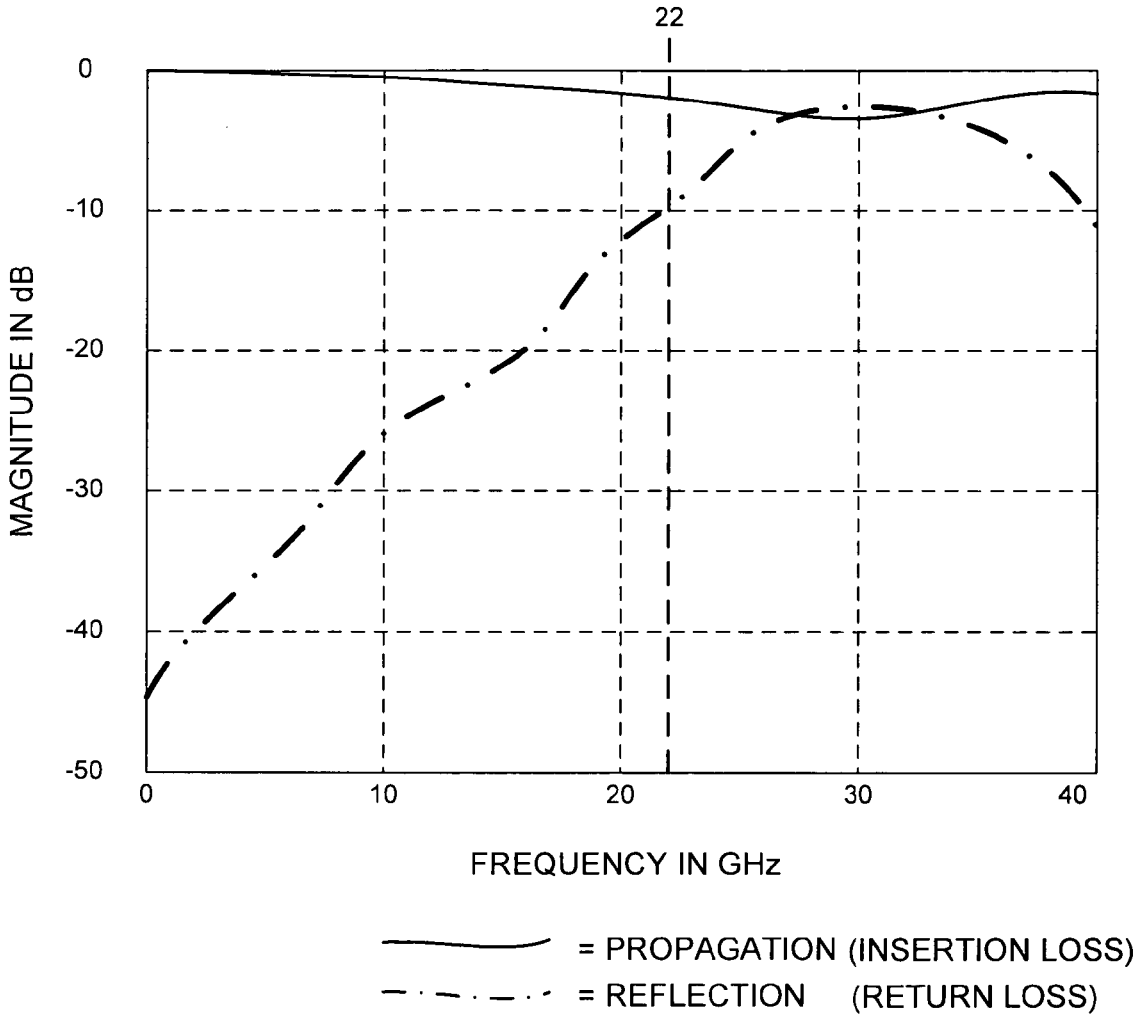
FIG. 39 is a graph illustrating electrical characteristics (insertion loss and return loss) of the novel connector assembly of FIG. 11.

FIG. 39 is a graph showing electrical characteristics of novel connector assembly 100. At a signal rate of 22 gigahertz, the insertion loss is better than −3 dB (the signal propagation has degraded by less than 3 dB), and the return loss is better than −10 dB (the magnitude of reflections is less than −10 dB). Where standards require both an insertion loss of better than −3 dB and a return loss of better than −10 dB, the connector assembly 100 is said to be able to handle signals up to 22 gigahertz.

Figure 40:
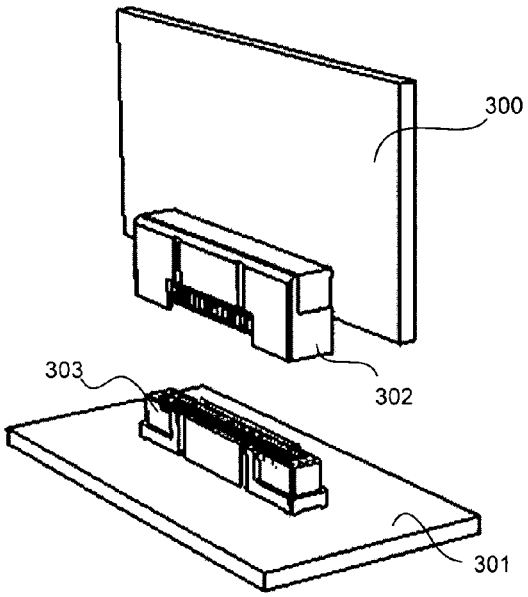
FIG. 40 is a perspective view of a "vertical mating" embodiment of the novel connector assembly.

FIG. 40 is a perspective view of an alternative embodiment where the printed circuit boards 300 and 301 are not disposed parallel to one another as in the case of a stacking connector assembly, but rather are disposed at right angles with respect to one another. The connector assembly is called a "vertical mating" connector. Male connector 302 is surface mounted to printed circuit board 300. Female connector 303 is mounted to printed circuit board 301.

Figure 41:
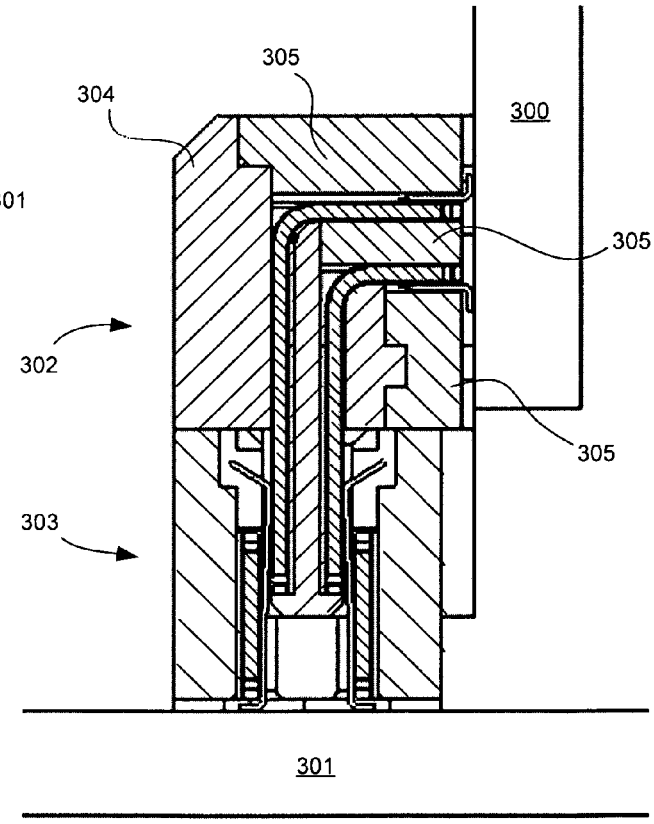
FIG. 41 is a cross-sectional view of the vertical mating embodiment of FIG. 40.

FIG. 41 is a cross-sectional diagram of the connector assembly of FIG. 40. Female connector 303 has an identical construction to the female connector 102 described above. Male connector 302, however, has two insulative portions 304 and 305 rather than just one insulative portion as in the example of FIG. 25. In a first assembly step, the first and second PCAPs are assembled and inserted into receiving slits in insulative portion 304. The upper ends of the PCAPs extend upward from the top of the insulative portion 304. Rather than the printed circuits of the PCAPs being rigid printed circuit, the printed circuits of the PCAPs of FIG. 41 are flexible printed circuits. The surface mount attachment structures at this point are not bent, but rather are attached to the printed circuits but extend straight in the plane of the printed circuits. The printed circuits are then bent ninety degrees to the right. The bent ends of the printed circuits are slid into receiving slits in the second insulative portion 305. The first and second insulative portions 304 and 305 snap together as illustrated in cross-section in FIG. 41. The ends of the surface mount attachment structures are then bent so that they appear as shown in cross-section in FIG. 41. The resulting ninety degree male connector 302 is soldered to printed circuit board 300. Female connector 303 is soldered to printed circuit board 301. The male and female connectors are then brought together and mated to form the structure illustrated in FIG. 41.

Figure 42:
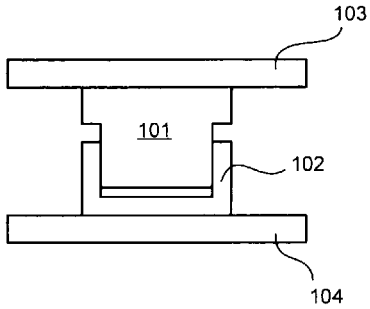
FIG. 42 is a diagram of the stacking connector assembly of FIGS. 11–39.
Figure 43:
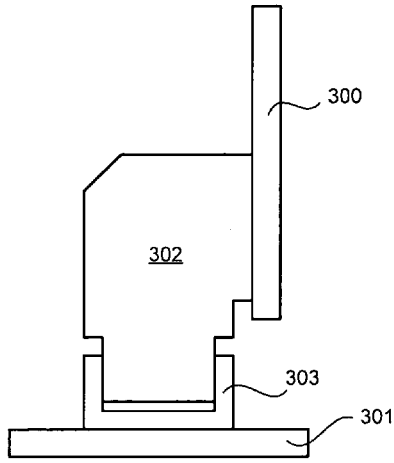
FIG. 43 is a diagram of the vertical mating connector assembly of FIGS. 40–41.
Figure 44:
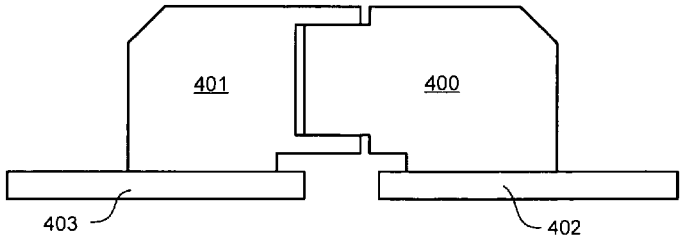
FIG. 44 is a diagram of a horizontal mating embodiment of the novel connector assembly.
Figure 45:
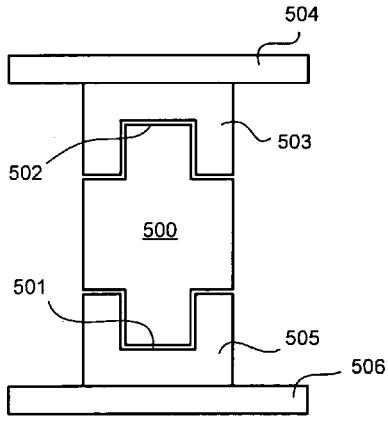
FIG. 45 is a diagram of an extended parallel mating structure in accordance with the novel connector assembly.

The novel connector structure having a female connector with two printed circuits and opposing sets of contact beams can take multiple different forms. FIG. 42 shows the stacking embodiment described above in connection with FIGS. 11–39. FIG. 43 shows the vertical mating embodiment of FIGS. 40 and 41. FIG. 44 shows a horizontal mating embodiment. Both the male and female connectors 400 and 401 are made using flexible printed circuits as described in connection with the vertical mating embodiment such that both the female connector and the male connector are ninety degree connectors. The first and second printed circuit boards 402 and 403 are disposed in the same approximate plane. FIG. 45 illustrates an embodiment involving an extension portion 500 that has two male ends 501 and 502. Each male end has the form illustrated above in FIG. 25. A first female connector 503 of the type illustrated in FIG. 13 is soldered to a first printed circuit board 504. A second female connector 505 is soldered to a second printed circuit board 506. Signal traces in the first printed circuit board 504 are coupled to corresponding signal traces in the second printed circuit board 506 through the assembly involving the two female connectors 503 and 505 and the male—male extension connector 500.

In another embodiment, a novel connector assembly includes female surface mount attachment connector and a male surface mount attachment connector. The female connector has a PCAP and a contact beam portion, wherein the PCAP and the contact beam portion are coupled to and disposed in an insulative housing such that contact beams of the PCAP face opposing contact beams of the contact beam portion. The contact beam portion does not include a printed circuit but rather is a set of stamped metal members, where one end of each member is a contact beam that faces the PCAP and where the other end of each member is a surface mount attachment feature.

In one embodiment, one (or both) of the PCAPs of a connector assembly (for example, the connector assembly of FIG. 11) includes contact beams and a printed circuit. The printed circuit includes a ground plane as described above in connection with FIG. 13, but the PCAP further includes circuitry disposed on the printed circuit. In the diagram of FIG. 13, the circuitry is surface mounted to the outwardly facing surface of printed circuit 111. The ground plane is a ground plane inside the printed circuit 111, whereas the circuitry is soldered to traces or solder pads on the outwardly facing printed circuit board surface. The contact beams are soldered to the inwardly facing surface of the printed circuit. The circuitry may, for example, include: 1) memory integrated circuits, 2) discrete components such as capacitors, inductors, and resistors, 3) communication circuitry such as SERDES integrated circuits, 4) impedance matching integrated circuits, the impedance of which can be controlled to facilitate the communication of electrical signals through the connector assembly. The circuitry can be disposed in this way on any one of the printed circuits appearing in the connector assembly of FIG. 11, including printed circuits in the male connector.

Although the present invention has been described in connection with certain specific embodiments for instructional purposes, the present invention is not limited thereto. Accordingly, various modifications, adaptations, and combinations of various features of the described embodiments can be practiced without departing from the scope of the invention as set forth in the claims.

What is claimed is:

1. A connector assembly comprising:

a female connector comprising:

an insulative housing portion;

a first printed circuit assembly portion (PCAP) comprising a first printed circuit (PC) and a first plurality of contact beams that are attached to the first printed circuit, the first printed circuit comprising a first ground plane; and a second printed circuit assembly portion (PCAP) comprising a second printed circuit (PC) and a second plurality of contact beams that are attached to the second printed circuit, the second printed circuit comprising a second ground plane, wherein the first and second PCAPs are coupled to the insulative housing such that a male connector receiving slot (MCRS) is formed between the first set of contact beams of the first PCAP and the second plurality of contact beams of the second PCAP; and a male connector having a first side and a second side, a first plurality of conductors being disposed on the first side, a second plurality of conductors being disposed on the second side, wherein when a portion of the male connector is inserted into the MCRS of the female connector the first plurality of contact beams press on the first side of male connector and the second plurality of contact beams press on the second side of the male connector.

2. The connector assembly of claim 1, wherein the first PCAP includes a first plurality of surface mount attachment features, wherein the second PCAP includes a second plurality of surface mount attachment features, the first and second pluralities of surface mount attachment features being adapted for surface mount attaching the female connector to a first printed circuit board.

3. The connector assembly of claim 2, wherein some of the first plurality of contact beams are ground contact beams, wherein others of the first plurality of contact beams are signal contact beams, wherein the ground contact beams of the first plurality of contact beams are electrically coupled to the first ground plane, and wherein each of the signal contact beams of the first plurality of contact beams is not electrically coupled to the first ground plane and is not electrically coupled to any other one of the first plurality of contact beams, and wherein some of the second plurality of contact beams are ground contact beams, wherein others of the second plurality of contact beams are signal contact beams, wherein the ground contact beams of the second plurality of contact beams are electrically coupled to the second ground plane, and wherein each of the signal contact beams of the second plurality of contact beams is not electrically coupled to the second ground plane and is not electrically coupled to any of other one of the second plurality of contact beams.

4. The connector assembly of claim 2, wherein the first PCAP further comprises a first stamped metal stiffener, and wherein the second PCAP further comprises a second stamped metal stiffener.

5. The connector assembly of claim 2, wherein the male connector comprises:

a first printed circuit assembly portion (PCAP) comprising a plurality of conductors and a ground plane, the plurality of conductors of the first PCAP being the first plurality of conductors of the male connector, wherein when the portion of the male connector is inserted into the MCRS of the female connector each of the first plurality of conductors of the first PCAP of the male connector makes electrical contact with a corresponding one of the first plurality of contact beams of the first PCAP of the female connector; and a second printed circuit assembly portion (PCAP) comprising a plurality of conductors and a ground plane, the plurality of conductors of the second PCAP being the second plurality of conductors of the male connector, wherein when the portion of the male connector is inserted into the MCRS of the female connector each of the second plurality of conductors of the second PCAP of the male connector makes electrical contact with a corresponding one of the second plurality of contact beams of the second PCAP of the female connector.

6. The connector assembly of claim 5, wherein the first PCAP of the male connector includes a first plurality of surface mount attachment features, wherein the second PCAP of the male connector includes a second plurality of surface mount attachment features, the first and second pluralities of surface mount attachment features of the male connector being adapted for surface mount attaching the male connector to a second printed circuit board.

7. The connector assembly of claim 6, wherein a conductive path is established from one of the first plurality of surface mount attachment features of the female connector to one of the first plurality of surface mount attachment features of the male connector, the conductive path having a characteristic impedance that varies by less than plus or minus ten percent.

8. The connector assembly of claim 6, wherein a conductive path is established from one of the first plurality of surface mount attachment features of the female connector to one of the first plurality of surface mount attachment features of the male connector, wherein at a signal rate of 20 gigahertz down the conductive path there is better than −3 dB signal loss and a better than −10 dB return loss.

9. The connector assembly of claim 5, wherein the plurality of conductors and the ground plane of the first PCAP of the male connector are parts of a first printed circuit (PC) of the male connector, wherein the plurality of conductors and the ground plane of the second PCAP of the male connector are parts of a second printed circuit (PC) of the male connector.

10. A connector assembly comprising:

a female surface mount connector comprising:

an insulative housing portion;

a first printed circuit assembly portion (PCAP) comprising a first printed circuit (PC) and a first plurality of contact beams that are attached to the first PC, the first PC comprising a first ground plane; and a second printed circuit assembly portion (PCAP) comprising a second printed circuit (PC) and a second plurality of contact beams that are attached to the second PC, the second PC comprising a second ground plane, wherein the first and second PCAPs are coupled to the insulative housing such that a male connector receiving slot (MCRS) is formed between the first set of contact beams of the first PCAP and the second plurality of contact beams of the second PCAP; and a male surface mount connector comprising:

an insulative portion;

a first printed circuit assembly portion (PCAP) comprising a first printed circuit (PC), the first PC comprising a first plurality of conductors and a first ground plane; and a second printed circuit assembly portion (PCAP) comprising a second printed circuit (PC), the second PC comprising a second plurality of conductors a second ground plane, wherein when a portion of the male connector is inserted into the MCRS of the female connector each of the first plurality of contact beams of the first PCAP of the female connector makes electrical contact with a corresponding one of the first plurality of conductors of the first PCAP of the male connector, wherein when the portion of the male connector is inserted into the MCRS of the female connector each of the second plurality of contact beams of the second PCAP of the female connector makes electrical contact with a corresponding one of the second plurality of conductors of the second PCAP of the male connector, wherein when the portion of the male connector is inserted into the MCRS of the female connector the first ground plane of the female connector is electrically coupled to the first ground plane of the male connector, wherein when the portion of the male connector is inserted into the MCRS of the female connector the second ground plane of the female connector is electrically coupled to the second ground plane of the male connector, and wherein when the portion of the male connector is inserted into the MCRS of the female connector the portion of the male connector is pressed between the first plurality of contact beams and the second plurality of contact beams.

11. The connector assembly of claim 10, wherein the first PCAP of the female connector further comprises a surface mount attachment feature, wherein the first PCAP of the male connector further comprises a surface mount attachment feature, wherein when the portion of the male connector is inserted into the MCRS of the female connector a conductive path is established from the surface mount attachment feature of the first PCAP of the female connector through the connector assembly and to the surface mount attachment feature of the first PCAP of the male connector, wherein at a signal rate of 20 gigahertz down the conductive path there is better than −3 dB signal loss and a better than −10 dB return loss.

12. The connector assembly of claim 11, wherein a plurality of the first plurality of contact beams of the female connector is electrically coupled to the first ground plane of the first PC of the female connector, and wherein a plurality of the second plurality of contact beams of the female connector is electrically coupled to the second ground plane of the second PC of the female connector.

13. The connector assembly of claim 11, wherein the first PC of the female connector includes conductive through holes that electrically couple the first ground plane to ones of the first plurality of contact beams of the female connector, and wherein the second PC of the female connector includes conductive through holes that electrically couple the second ground plane to ones of the second plurality of contact beams of the female connector.

14. The connector assembly of claim 11, wherein the first PC of the female connector further comprises a first plurality of conductors, wherein each of the first plurality of contact beams of the female connector is coupled to a corresponding one of the first plurality of conductors of the first PC of the female connector, wherein the second PC of the female connector further comprises a second plurality of conductors, wherein each of the second plurality of contact beams of the female connector is coupled to a corresponding one of the second plurality of conductors of the second PC of the female connector.

15. The connector assembly of claim 11, wherein the first PCAP of the female connector further comprises a stiffener, wherein the second PCAP of the female connector further comprises a stiffener, wherein the first PCAP of the male connector further comprises a stiffener, and wherein the second PCAP of the male connector further comprises a stiffener.

16. The connector assembly of claim 11, wherein every third one of the first plurality of contact beams of the female connector is coupled to the first ground plane of the female connector, and wherein every third one of the second plurality of contact beams of the female connector is coupled to the second ground plane of the female connector.

17. A method comprising:

providing a pair of printed circuits (PCs) in a female surface mount connector, wherein each of the PCs includes a ground plane and a plurality of conductors;

providing a first plurality of contact beams, wherein each of the first plurality of contact beams is connected to a corresponding one of the conductors of a first one of the pair of PCs; and providing a second plurality of contact beams, wherein each of the second plurality of contact beams is connected to a corresponding one of the conductors of a second one of the pair of PCs, wherein the first plurality of contact beams are flexible in a direction away from the second plurality of contact beams, and wherein the second plurality of contact beams are flexible in a direction away from the first plurality of contact beams.

18. The method of claim 17, further comprising:

providing a male surface mount connector that is disengageably connectable to the female surface mount connector such that a conductive path is established from a surface mount feature on the female connector, through one of the contact beams of the female connector and to a surface mount feature on the male connector, wherein at a signal rate of 20 gigahertz down the conductive path there is better than −3 dB signal loss and a better than −10 dB return loss.

19. The method of claim 18, further comprising:

coupling every third one of the first plurality of contact beams to the ground plane of the first one of the pair of PCs; and coupling every third one of the second plurality of contact beams to the ground plane of the second one of the pair of PCs.

20. The method of claim 19, wherein when the male surface mount connector is disengageably connected to the female surface mount connector a portion of the male surface mount connector is disposed between the first plurality of contact beams and the second plurality of contact beams such that the first plurality of contact beams presses on one side of the male surface mount connector and the second plurality of contact beams presses on a side of the male surface mount connector that is opposite said one side.

* * * * *